US008790098B2

(12) United States Patent
Stover et al.

(10) Patent No.: US 8,790,098 B2
(45) Date of Patent: Jul. 29, 2014

(54) COMPRESSOR HAVING OUTPUT ADJUSTMENT ASSEMBLY

(75) Inventors: Robert C. Stover, Versailles, OH (US); Masao Akei, Miamisburg, OH (US); Michael M. Perevozchikov, Tipp City, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 0 days.

(21) Appl. No.: 13/165,306

(22) Filed: Jun. 21, 2011

(65) Prior Publication Data

US 2011/0250085 A1 Oct. 13, 2011

Related U.S. Application Data

(63) Continuation of application No. 12/474,868, filed on May 29, 2009, now Pat. No. 7,972,125.

(60) Provisional application No. 61/057,372, filed on May 30, 2008.

(51) Int. Cl.

| | |
|---|---|
| ***F03C 2/00*** | (2006.01) |
| ***F04C 18/00*** | (2006.01) |
| ***F04C 23/00*** | (2006.01) |
| ***F04C 18/02*** | (2006.01) |
| ***F04C 28/16*** | (2006.01) |

(52) U.S. Cl.

CPC ..... *F04C 23/008* (2013.01); *F04C 18/0215* (2013.01); *F04C 28/16* (2013.01)

USPC ..... 418/55.5; 418/15; 418/55.1; 418/55.4; 418/57; 418/180; 418/270; 417/310; 417/307; 417/440

(58) Field of Classification Search

USPC ..... 418/15, 55.1–55.6, 57, 180, 270; 417/310, 307, 308, 299, 440

See application file for complete search history.

(56) References Cited

U.S. PATENT DOCUMENTS

| | | | |
|---|---|---|---|
| 4,382,370 | A | 5/1983 | Suefuji et al. |
| 4,383,805 | A | 5/1983 | Teegarden et al. |

(Continued)

FOREIGN PATENT DOCUMENTS

| | | | |
|---|---|---|---|
| CN | 1060699 | A | 4/1992 |
| CN | 1028379 | C | 5/1995 |

(Continued)

OTHER PUBLICATIONS

International Search Report dated Jan. 29, 2010 regarding International Application No. PCT/US2009/045647, 3 pages.

(Continued)

*Primary Examiner* — Theresa Trieu

(74) *Attorney, Agent, or Firm* — Harness, Dickey & Pierce, P.L.C.

(57) ABSTRACT

A compressor includes a housing, a first scroll member, a second scroll member and a valve assembly. The first scroll member is positioned within the housing and includes a first end plate portion and a second end plate portion coupled to the first end plate portion and having a first spiral wrap extending therefrom. The first end plate portion and the second end plate portion define a discharge passage. The second scroll member is positioned within the housing and includes a second spiral wrap meshingly engaged with the first spiral wrap. The valve assembly is supported by at least one of the first end plate portion and the second end plate portion at a location radially outward from the discharge passage.

25 Claims, 14 Drawing Sheets

(56) References Cited

U.S. PATENT DOCUMENTS

| | | | |
|---|---|---|---|
| 4,431,388 | A | 2/1984 | Eber et al. |
| 4,475,360 | A | 10/1984 | Suefuji et al. |
| 4,497,615 | A | 2/1985 | Griffith |
| 4,557,675 | A | 12/1985 | Murayama et al. |
| 4,669,962 | A | 6/1987 | Mizuno et al. |
| 4,676,075 | A | 6/1987 | Shiibayashi |
| 4,767,293 | A | 8/1988 | Caillat et al. |
| 4,774,816 | A | 10/1988 | Uchikawa et al. |
| 4,818,195 | A | 4/1989 | Murayama et al. |
| 4,904,164 | A | 2/1990 | Mabe et al. |
| 4,904,165 | A | 2/1990 | Fraser, Jr. et al. |
| 4,940,395 | A | 7/1990 | Yamamoto et al. |
| 5,074,760 | A | 12/1991 | Hirooka et al. |
| 5,087,170 | A | 2/1992 | Kousokabe et al. |
| 5,156,539 | A | 10/1992 | Anderson et al. |
| RE34,148 | E | 12/1992 | Terauchi et al. |
| 5,169,294 | A | 12/1992 | Barito |
| 5,192,195 | A | 3/1993 | Iio et al. |
| 5,193,987 | A | 3/1993 | Iio et al. |
| 5,240,389 | A | 8/1993 | Oikawa et al. |
| 5,336,058 | A | 8/1994 | Yokoyama |
| 5,356,271 | A | 10/1994 | Miura et al. |
| 5,451,146 | A | 9/1995 | Inagaki et al. |
| 5,469,716 | A | 11/1995 | Bass et al. |
| 5,551,846 | A | 9/1996 | Taylor et al. |
| 5,557,897 | A | 9/1996 | Kranz et al. |
| 5,562,426 | A | 10/1996 | Watanabe et al. |
| 5,577,897 | A | 11/1996 | Inagaki et al. |
| 5,607,288 | A | 3/1997 | Wallis et al. |
| 5,611,674 | A | 3/1997 | Bass et al. |
| 5,639,225 | A | 6/1997 | Matsuda et al. |
| 5,640,854 | A | 6/1997 | Fogt et al. |
| 5,674,058 | A | 10/1997 | Matsuda et al. |
| 5,678,985 | A | 10/1997 | Brooke et al. |
| 5,741,120 | A | 4/1998 | Bass et al. |
| 5,803,716 | A | 9/1998 | Wallis et al. |
| 5,810,573 | A | 9/1998 | Mitsunaga et al. |
| 5,833,442 | A | 11/1998 | Park et al. |
| 5,855,475 | A | 1/1999 | Fujio et al. |
| 5,885,063 | A | 3/1999 | Makino et al. |
| 5,993,171 | A | 11/1999 | Higashiyama |
| 5,993,177 | A | 11/1999 | Terauchi et al. |
| 5,996,364 | A | 12/1999 | Lifson et al. |
| 6,077,057 | A | 6/2000 | Hugenroth et al. |
| 6,086,335 | A | 7/2000 | Bass et al. |
| 6,102,671 | A | 8/2000 | Yamamoto et al. |
| 6,123,517 | A | 9/2000 | Brooke et al. |
| 6,132,179 | A | 10/2000 | Higashiyama |
| 6,164,940 | A | 12/2000 | Terauchi et al. |
| 6,176,686 | B1 | 1/2001 | Wallis et al. |
| 6,210,120 | B1 | 4/2001 | Hugenroth et al. |
| 6,213,731 | B1 | 4/2001 | Doepker et al. |
| 6,231,316 | B1 | 5/2001 | Wakisaka et al. |
| 6,273,691 | B1 | 8/2001 | Morimoto et al. |
| 6,293,767 | B1 | 9/2001 | Bass |
| 6,295,821 | B1 | 10/2001 | Madigan |
| 6,350,111 | B1 | 2/2002 | Perevozchikov et al. |
| 6,412,293 | B1 | 7/2002 | Pham et al. |
| 6,413,058 | B1 | 7/2002 | Williams et al. |
| 6,430,959 | B1 | 8/2002 | Lifson |
| 6,454,551 | B2 | 9/2002 | Kuroki et al. |
| 6,464,481 | B2 | 10/2002 | Tsubai et al. |
| 6,506,036 | B2 | 1/2003 | Tsubai et al. |
| 6,544,016 | B2 | 4/2003 | Gennami et al. |
| 6,558,143 | B2 | 5/2003 | Nakajima et al. |
| 6,589,035 | B1 | 7/2003 | Tsubono et al. |
| 6,619,062 | B1 | 9/2003 | Shibamoto et al. |
| 6,679,683 | B2 | 1/2004 | Seibel et al. |
| 6,769,888 | B2 | 8/2004 | Tsubono et al. |
| 6,821,092 | B1 | 11/2004 | Gehret et al. |
| 6,881,046 | B2 | 4/2005 | Shibamoto et al. |
| 6,884,042 | B2 | 4/2005 | Zili et al. |
| 6,984,114 | B2 | 1/2006 | Zili et al. |
| 7,118,358 | B2 | 10/2006 | Tsubono et al. |
| 7,137,796 | B2 | 11/2006 | Tsubono et al. |
| 7,228,710 | B2 | 6/2007 | Lifson |
| 7,229,261 | B2 | 6/2007 | Morimoto et al. |
| 7,278,832 | B2 | 10/2007 | Lifson et al. |
| 7,326,039 | B2 | 2/2008 | Kim et al. |
| 7,344,365 | B2 | 3/2008 | Takeuchi et al. |
| RE40,257 | E | 4/2008 | Doepker et al. |
| 7,354,259 | B2 | 4/2008 | Tsubono et al. |
| RE40,344 | E | 5/2008 | Perevozchikov et al. |
| 7,404,706 | B2 | 7/2008 | Ishikawa et al. |
| 7,513,753 | B2 | 4/2009 | Shin et al. |
| 7,547,202 | B2 | 6/2009 | Knapke |
| 7,674,098 | B2 | 3/2010 | Lifson |
| 7,771,178 | B2 | 8/2010 | Perevozchikov et al. |
| 7,815,423 | B2 | 10/2010 | Guo et al. |
| 7,967,582 | B2 | 6/2011 | Akei et al. |
| 7,967,583 | B2 | 6/2011 | Stover et al. |
| 7,972,125 | B2 | 7/2011 | Stover et al. |
| 7,976,295 | B2 | 7/2011 | Stover et al. |
| 7,976,296 | B2 | 7/2011 | Stover et al. |
| 7,988,433 | B2 | 8/2011 | Akei et al. |
| 7,988,434 | B2 | 8/2011 | Stover et al. |
| 8,313,318 | B2 | 11/2012 | Stover et al. |
| 8,475,140 | B2 | 7/2013 | Seibel et al. |
| 2001/0010800 | A1 | 8/2001 | Kohsokabe et al. |
| 2002/0039540 | A1 | 4/2002 | Kuroki et al. |
| 2003/0012659 | A1 | 1/2003 | Seibel et al. |
| 2004/0071571 | A1 | 4/2004 | Uchida et al. |
| 2004/0146419 | A1 | 7/2004 | Kawaguchi et al. |
| 2004/0197204 | A1 | 10/2004 | Yamanouchi et al. |
| 2005/0019177 | A1 | 1/2005 | Shin et al. |
| 2005/0053507 | A1 | 3/2005 | Takeuchi et al. |
| 2006/0165542 | A1 | 7/2006 | Sakitani et al. |
| 2007/0053782 | A1 | 3/2007 | Okamoto et al. |
| 2007/0092390 | A1 | 4/2007 | Ignatiev et al. |
| 2007/0231172 | A1 | 10/2007 | Fujimura et al. |
| 2007/0237664 | A1 | 10/2007 | Joo et al. |
| 2007/0245892 | A1 | 10/2007 | Lemke et al. |
| 2007/0269326 | A1 | 11/2007 | Seibel et al. |
| 2008/0025861 | A1 | 1/2008 | Okawa et al. |
| 2008/0107555 | A1 | 5/2008 | Lifson |
| 2008/0159892 | A1 | 7/2008 | Huang et al. |
| 2009/0068048 | A1 | 3/2009 | Stover et al. |
| 2009/0071183 | A1 | 3/2009 | Stover et al. |
| 2009/0196781 | A1 | 8/2009 | Kiem et al. |
| 2009/0297377 | A1 | 12/2009 | Stover et al. |
| 2009/0297378 | A1 | 12/2009 | Stover et al. |
| 2009/0297379 | A1 | 12/2009 | Stover et al. |
| 2009/0297380 | A1 | 12/2009 | Stover et al. |
| 2010/0111741 | A1 | 5/2010 | Chikano et al. |
| 2010/0135836 | A1 | 6/2010 | Stover et al. |
| 2010/0158731 | A1 | 6/2010 | Akei et al. |
| 2010/0254841 | A1 | 10/2010 | Akei et al. |
| 2010/0300659 | A1 | 12/2010 | Stover et al. |
| 2010/0303659 | A1 | 12/2010 | Stover et al. |
| 2011/0033328 | A1 | 2/2011 | Stover et al. |
| 2011/0103988 | A1 | 5/2011 | Stover et al. |
| 2011/0256009 | A1 | 10/2011 | Stover et al. |

FOREIGN PATENT DOCUMENTS

| | | | |
|---|---|---|---|
| CN | 1137614 | A | 12/1996 |
| CN | 1434216 | A | 8/2003 |
| CN | 1475673 | A | 2/2004 |
| CN | 1576603 | A | 2/2005 |
| CN | 1707104 | A | 12/2005 |
| CN | 100334352 | C | 8/2007 |
| CN | 100343521 | C | 10/2007 |
| JP | 03081588 | A | 4/1991 |
| JP | 05001677 | A | 1/1993 |
| JP | 2550612 | B2 | 11/1996 |
| JP | 2000161263 | A | 6/2000 |
| JP | 2007154761 | A | 6/2007 |
| WO | 2009155109 | | 12/2009 |

OTHER PUBLICATIONS

Written Opinion of the International Searching Authority dated Jan. 29, 2010 regarding International Application No. PCT/US2009/045647, 3 pages.

(56) References Cited

OTHER PUBLICATIONS

International Search Report dated Jan. 4, 2010 regarding International Application No. PCT/US2009/045666.
International Search Report dated Jan. 21, 2010 regarding International Application No. PCT/US2009/045638.
Written Opinion of the International Searching Authority dated Jan. 21, 2010 regarding International Application No. PCT/US2009/045638, 3 pages.
International Search Report dated Jan. 8, 2010 regarding International Application No. PCT/US2009/045665.
Written Opinion of the International Searching Authority dated May 31, 2010 regarding International Application No. PCT/US2009/066551, 3 pgs.
International Search Report regarding Application No. PCT/US2010/036586, mailed Jan. 17, 2011.
International Search Report dated Jan. 29, 2010 regarding International Application No. PCT/US2009/045647.
Written Opinion of the International Searching Authority dated Jan. 29, 2010 regarding International Application No. PCT/US2009/045647.
Non-Final Office Action for U.S. Appl. No. 12/474,806, mailed Jun. 18, 2012.
Non-Final Office Action for U.S. Appl. No. 12/909,303, mailed Jan. 10, 2013.
International Search Report dated Jan. 14, 2010 regarding International Application No. PCT/US2009/045672.
Written Opinion of the International Searching Authority dated Jan. 14, 2010 regarding International Application No. PCT/US2009/045672.
Non-Final Office Action for U.S. Appl. No. 13/367,950, mailed Jan. 11, 2013.
Non-Final Office Action for U.S. Appl. No. 13/167,192, mailed Jan. 25, 2013.
First Office Action regarding Chinese Patent Application No. 2009801269614.4, dated Feb. 5, 2013. English translation provided by Unitalen Attorneys at Law.
Written Opinion of the International Searching Authority dated Jan. 4, 2010 regarding Inernational Application No. PCT/US2009/045666.
Written Opinion of the International Search Authority dated Jan. 8, 2010 regarding International Application No. PCT/US2009/045665.
Written Opinion of the International Searching Authority regarding Application No. PCT/US2010/036586, mailed Jan. 17, 2011.
International Search Report dated May 31, 2010 regarding International Application No. PCT/US2009/066551, 3 pgs.
First Office Action and Search Report regarding Chinese Patent Application No. 200980126962.9, issued on Apr. 2, 2013. English translation provided by Unitalen Attorneys at Law.
First Office Action regarding Chinese Patent Application No. 200980125441.1, dated May 31, 2013. English translation provided by Unitalen Attorneys At Law.
U.S. Office Action regarding U.S. Appl. No. 12/788,786 mailed Jan. 3, 2013.
First Office Action regarding China Application No. 201080023038.0 dated Dec. 17, 2013. Translation provided by Unitalen Attorneys at Law.
First Office Action regarding Chinese Patent Application No. 2012100398842, dated Jan. 20, 2014, and Search English translation provided by Unitalen Attorneys at Law.

COMPRESSOR HAVING OUTPUT ADJUSTMENT ASSEMBLY

CROSS-REFERENCE TO RELATED APPLICATIONS

This application is a continuation of U.S. patent application Ser. No. 12/474,868 filed on May 29, 2009 which claims the benefit of U.S. Provisional Application No. 61/057,372, filed on May 30, 2008. The entire disclosures of each of the above applications are incorporated herein by reference.

FIELD

The present disclosure relates to compressors, and more specifically to compressors having output adjustment assemblies.

BACKGROUND

This section provides background information related to the present disclosure which is not necessarily prior art.

Scroll compressors include a variety of output adjustment assemblies to vary operating capacity of a compressor. The output adjustment assemblies may include fluid passages extending through a scroll member to selectively provide fluid communication between compression pockets and another pressure region of the compressor.

SUMMARY

A compressor may include a housing, a first scroll member, a second scroll member and a valve assembly. The first scroll member may be positioned within the housing and may include a first end plate portion and a second end plate portion coupled to the first end plate portion and having a first spiral wrap extending therefrom. The first end plate portion and the second end plate portion may define a discharge passage. The second scroll member may be positioned within the housing and may include a second spiral wrap meshingly engaged with the first spiral wrap. The valve assembly may be supported by at least one of the first end plate portion and the second end plate portion at a location radially outward from the discharge passage.

The compressor may additionally include a drive shaft engaged with the second scroll member to drive orbital displacement of the second scroll member relative to the first scroll member.

The compressor may additionally include a first seal engaged with the housing and the first end plate portion and located within a recess defined in the first end plate portion. The first and second end plate portions may define a biasing passage extending therethrough and providing communication between a pocket formed by the first and second spiral wraps and the recess. The compressor may additionally include a second seal located axially between and engaged with the first and second end plate portions. The second seal may surround the biasing passage.

The valve assembly may be in communication with the discharge passage and may form a variable volume ratio valve assembly. The second end plate portion may define a first variable volume ratio passage in communication with a first pocket formed by the first and second spiral wraps. The variable volume ratio valve assembly may include a first variable volume ratio valve overlying the first variable volume ratio passage and displaceable between open and closed positions. The first variable volume ratio passage may provide communication between the first pocket and the discharge passage when the first variable volume ratio valve is in the open position and the first variable volume ratio passage may be isolated from the discharge passage when the first variable volume ratio valve is in the closed position.

The second end plate portion may define a second variable volume ratio passage in communication with a second pocket formed by the first and second spiral wraps. The variable volume ratio valve assembly may include a second variable volume ratio valve overlying the second variable volume ratio passage and displaceable between open and closed positions independently from the first variable volume ratio valve. The second variable volume ratio passage may provide communication between the second pocket and the discharge passage when the second variable volume ratio valve is in the open position and the second variable volume ratio passage may be isolated from the discharge passage when the second variable volume ratio valve is in the closed position. The second end plate portion may define multiple variable volume ratio passages including the first variable volume ratio passage in communication with the first variable volume ratio valve and may define multiple variable volume ratio passages including the second variable volume ratio passage in communication with the second variable volume ratio valve.

The compressor may additionally include a capacity modulation valve assembly supported by at least one of the first end plate portion and the second end plate portion at a location radially outward from the variable volume ratio valve assembly.

The valve assembly may be in communication with a suction pressure region of the compressor and may form a capacity modulation valve assembly. The second end plate portion may define a first capacity modulation passage in communication with a first pocket and the capacity modulation valve assembly may include a first capacity modulation valve overlying the first capacity modulation passage and displaceable between open and closed positions. The first capacity modulation passage may provide communication between the first pocket and the suction pressure region when the first capacity modulation valve is in the open position and the first capacity modulation passage may be isolated from the suction pressure region when the first capacity modulation valve is in the closed position. The second end plate portion may define a second capacity modulation passage in communication with a second pocket and the capacity modulation valve assembly may include a second capacity modulation valve overlying the second capacity modulation passage and displaceable between open and closed positions independently from the first capacity modulation valve. The second capacity modulation passage may provide communication between the second pocket and the suction pressure region when the second capacity modulation valve is in the open position and the second capacity modulation passage may be isolated from the suction pressure region when the second capacity modulation valve is in the closed position.

In another arrangement, a compressor may include a housing, a first scroll member, a second scroll member and a valve assembly. The first scroll member may be positioned within the housing and may include a first end plate portion coupled to a second end plate portion having a first spiral wrap extending therefrom and defining an intermediate passage. The first end plate portion and the second end plate portion may define a discharge passage. The second scroll member may be supported within the housing and may include a second spiral wrap meshingly engaged with the first spiral wrap and defining a discharge pocket in communication with the discharge passage and an intermediate pocket in communication with the intermediate passage. The valve assembly may be in communication with the intermediate passage.

In another arrangement, a compressor may include a housing, a first scroll member, a second scroll member, a variable volume ratio valve assembly and a capacity modulation valve assembly. The first scroll member may be supported within the housing and may include a first end plate defining a discharge passage in communication with a discharge pressure region of the compressor, a first variable volume ratio passage and a first capacity modulation passage and a first spiral wrap extending from the first end plate. The second scroll member may be supported within the housing and may be meshingly engaged with the first scroll member to form a series of pockets including a first pocket in communication with the first variable volume ratio passage and a second pocket in communication with the first capacity modulation passage. The variable volume ratio valve assembly may be in communication with the first variable volume ratio passage and the discharge pressure region to selectively provide communication between the first pocket and the discharge pressure region. The capacity modulation valve assembly may be in communication with the first capacity modulation passage and a suction pressure region of the compressor to selectively provide communication between the second pocket and the suction pressure region.

The compressor may additionally include a seal engaged with the first scroll member and the housing and defining a biasing chamber. The first end plate may define a biasing passage in communication with the biasing chamber and a third pocket formed by the first and second scroll members. The biasing passage may be located radially outward relative to the first variable volume ratio passage and radially inward relative to the first capacity modulation passage.

The first end plate may define a second variable volume ratio passage in communication with a third pocket formed by the first and second scroll members and may define a second capacity modulation passage in communication with a fourth pocket formed by the first and second scroll members. The variable volume ratio valve assembly may include a first variable volume ratio valve controlling communication between the first pocket and the discharge pressure region and a second variable volume ratio valve controlling communication between the third pocket and the discharge pressure region independently from the first variable volume ratio valve. The capacity modulation valve assembly may include a first capacity modulation valve controlling communication between the second pocket and the suction pressure region and a second capacity modulation valve controlling communication between the fourth pocket and the suction pressure region independently from the first capacity modulation valve.

The compressor may additionally include a drive shaft engaged with the second scroll member to drive orbital displacement of the second scroll member relative to the first scroll member.

Further areas of applicability will become apparent from the description provided herein. The description and specific examples in this summary are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
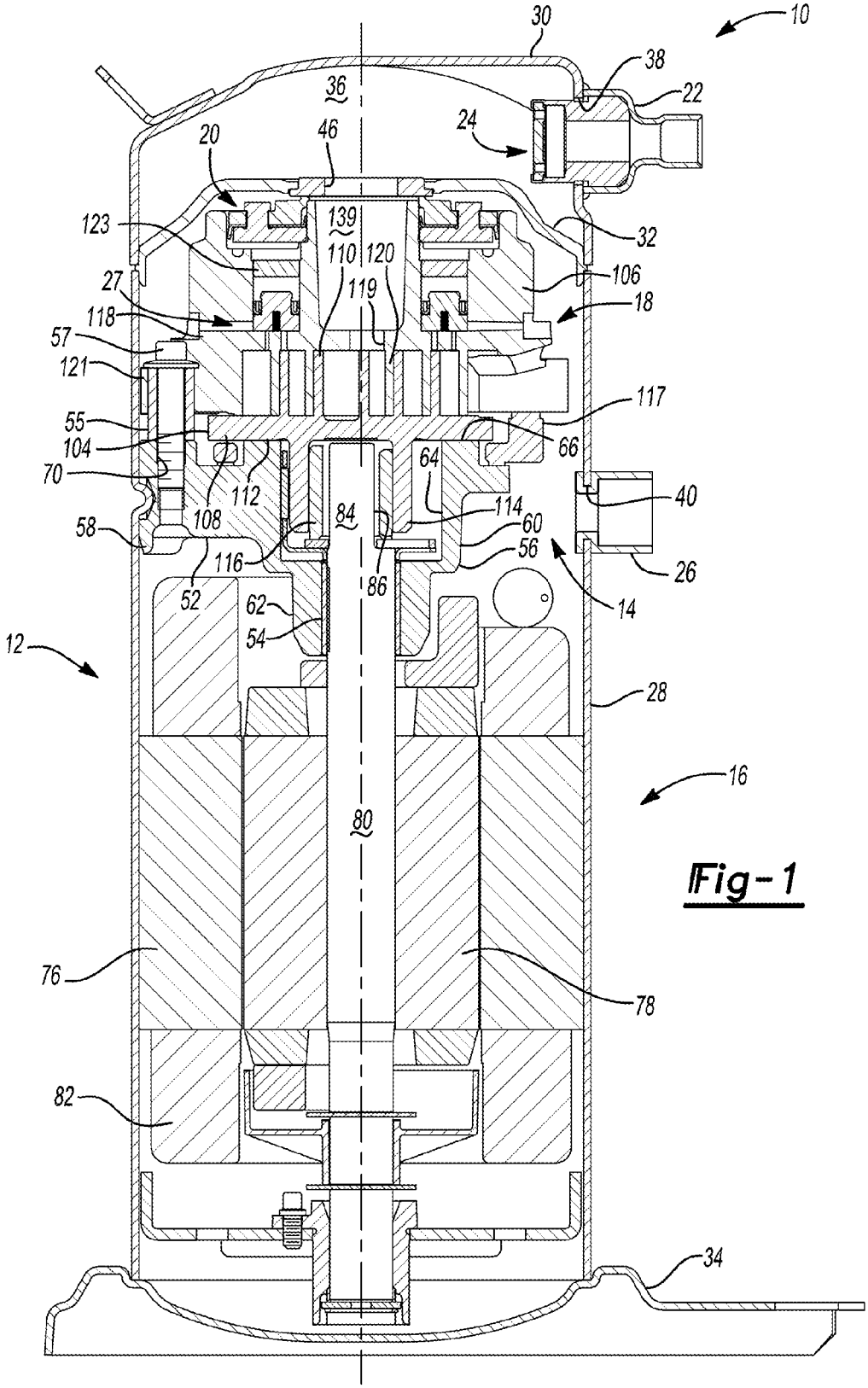
FIG. 1 is a section view of a compressor according to the present disclosure.
Figure 2:
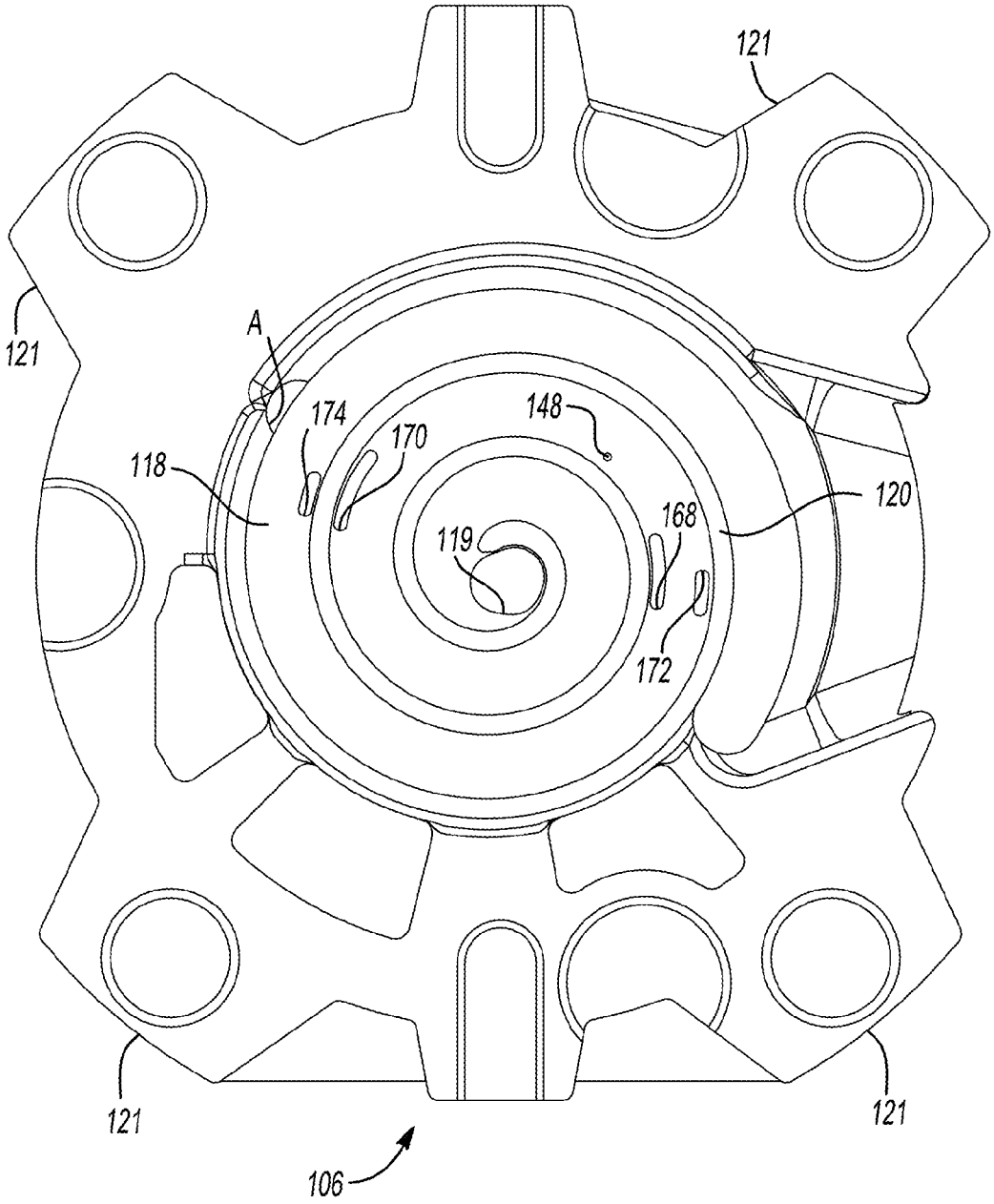
FIG. 2 is a plan view of a non-orbiting scroll of the compressor of FIG. 1.

The following description is merely exemplary in nature and is not intended to limit the present disclosure, application, or uses. It should be understood that throughout the drawings, corresponding reference numerals indicate like or corresponding parts and features.

The present teachings are suitable for incorporation in many different types of scroll and rotary compressors, including hermetic machines, open drive machines and non-hermetic machines. For exemplary purposes, a compressor 10 is shown as a hermetic scroll refrigerant-compressor of the low-side type, i.e., where the motor and compressor are cooled by suction gas in the hermetic shell, as illustrated in the vertical section shown in FIG. 1.

With reference to FIG. 1, compressor 10 may include a hermetic shell assembly 12, a main bearing housing assembly 14, a motor assembly 16, a compression mechanism 18, a seal assembly 20, a refrigerant discharge fitting 22, a discharge valve assembly 24, a suction gas inlet fitting 26, and a modulation assembly 27. Shell assembly 12 may house main bearing housing assembly 14, motor assembly 16, and compression mechanism 18.

Shell assembly 12 may generally form a compressor housing and may include a cylindrical shell 28, an end cap 30 at the upper end thereof, a transversely extending partition 32, and a base 34 at a lower end thereof. End cap 30 and partition 32 may generally define a discharge chamber 36. Discharge chamber 36 may generally form a discharge muffler for compressor 10. Refrigerant discharge fitting 22 may be attached to shell assembly 12 at opening 38 in end cap 30. Discharge valve assembly 24 may be located within discharge fitting 22 and may generally prevent a reverse flow condition. Suction gas inlet fitting 26 may be attached to shell assembly 12 at opening 40. Partition 32 may include a discharge passage 46 therethrough providing communication between compression mechanism 18 and discharge chamber 36.

Main bearing housing assembly 14 may be affixed to shell 28 at a plurality of points in any desirable manner, such as staking. Main bearing housing assembly 14 may include a main bearing housing 52, a first bearing 54 disposed therein, bushings 55, and fasteners 57. Main bearing housing 52 may include a central body portion 56 having a series of arms 58 extending radially outwardly therefrom. Central body portion 56 may include first and second portions 60, 62 having an opening 64 extending therethrough. Second portion 62 may house first bearing 54 therein. First portion 60 may define an annular flat thrust bearing surface 66 on an axial end surface thereof. Arm 58 may include apertures 70 extending therethrough and receiving fasteners 57.

Motor assembly 16 may generally include a motor stator 76, a rotor 78, and a drive shaft 80. Windings 82 may pass through stator 76. Motor stator 76 may be press fit into shell 28. Drive shaft 80 may be rotatably driven by rotor 78. Rotor 78 may be press fit on drive shaft 80. Drive shaft 80 may include an eccentric crank pin 84 having a flat 86 thereon.

Compression mechanism 18 may generally include an orbiting scroll 104 and a non-orbiting scroll 106. Orbiting scroll 104 may include an end plate 108 having a spiral vane or wrap 110 on the upper surface thereof and an annular flat thrust surface 112 on the lower surface. Thrust surface 112 may interface with annular flat thrust bearing surface 66 on main bearing housing 52. A cylindrical hub 114 may project downwardly from thrust surface 112 and may have a drive bushing 116 rotatively disposed therein. Drive bushing 116 may include an inner bore in which crank pin 84 is drivingly disposed. Crank pin flat 86 may drivingly engage a flat surface in a portion of the inner bore of drive bushing 116 to provide a radially compliant driving arrangement. An Oldham coupling 117 may be engaged with the orbiting and non-orbiting scrolls 104, 106 to prevent relative rotation therebetween.

With additional reference to FIGS. 2-5, non-orbiting scroll 106 may include an end plate 118 having a spiral wrap 120 on a lower surface thereof, a discharge passage 119 extending through end plate 118, and a series of radially outwardly extending flanged portions 121. Spiral wrap 120 may form a meshing engagement with wrap 110 of orbiting scroll 104, thereby creating a series of pockets. The pockets created by spiral wraps 110, 120 may change throughout a compression cycle of compression mechanism 18, as discussed below.

End plate 118 may include an annular recess 134 in the upper surface thereof defined by parallel coaxial inner and outer side walls 136, 138. Inner side wall 136 may form a discharge passage 139. End plate 118 may further include first and second discrete recesses 140, 142. First and second recesses 140, 142 may be located within annular recess 134. Plugs 144, 146 may be secured to end plate 118 at a top of first and second recesses 140, 142 to form first and second chambers 145, 147 isolated from annular recess 134. An aperture 148 (seen in FIG. 2) may extend through end plate 118 providing communication between one of the pockets and annular recess 134.

A first passage 150 may extend radially through end plate 118 from a first portion 152 (seen in FIG. 4) of first chamber 145 to an outer surface of non-orbiting scroll 106 and a second passage 154 (seen in FIG. 6) may extend radially through end plate 118 from a second portion 156 of first chamber 145 to an outer surface of non-orbiting scroll 106. A third passage 158 may extend radially through end plate 118 from a first portion 160 of second chamber 147 to an outer surface of non-orbiting scroll 106 and a fourth passage 162 may extend radially through end plate 118 from a second portion 164 of second chamber 147 to an outer surface of non-orbiting scroll 106. First and third passages 150, 158 may be in communication with a suction pressure region of compressor 10. A fifth passage 166 (FIG. 7) may extend radially through end plate 118 from a discharge pressure region of compressor 10 to an outer surface of non-orbiting scroll 106. For example, fifth passage 166 may extend from discharge passage 139 to an outer surface of non-orbiting scroll 106. Second, fourth, and fifth passages 154, 162, 166 may be in communication with modulation assembly 27, as discussed below.

A first set of ports 168, 170 may extend through end plate 118 and may be in communication with pockets operating at an intermediate pressure. Port 168 may extend into first portion 152 of first chamber 145 and port 170 may extend into first portion 160 of second chamber 147. An additional set of ports 172, 174 may extend through end plate 118 and may be in communication with additional pockets operating at an intermediate pressure. Port 172 may extend into first chamber 145 and port 174 may extend into second chamber 147. During compressor operation port 168 may be located in one of the pockets located at least one hundred and eighty degrees radially inward from a starting point (A) of wrap 120 and port 170 may be located in one of the pockets located at least three hundred and sixty degrees radially inward from starting point (A) of wrap 120. Port 168 may be located radially inward relative to port 172 and port 170 may be located radially inward relative to port 174. Ports 168, 170 may generally define the modulated capacity for compression mechanism 18. Ports 172, 174 may form auxiliary ports for preventing compression in pockets radially outward from ports 168, 170 when ports 168, 170, 172, 174 are exposed to a suction pressure region of compressor 10.

Seal assembly 20 may include a floating seal located within annular recess 134. Seal assembly 20 may be axially displaceable relative to shell assembly 12 and non-orbiting scroll 106 to provide for axial displacement of non-orbiting scroll 106 while maintaining a sealed engagement with partition 32 to isolate discharge and suction pressure regions of compressor 10 from one another. Pressure within annular recess 134 provided by aperture 148 may urge seal assembly 20 into engagement with partition 32 during normal compressor operation.

Modulation assembly 27 may include a valve assembly 176, and first and second piston assemblies 178, 180. Valve assembly 176 may include a solenoid valve having a housing 182 having a valve member 184 disposed therein. Housing 182 may include first, second, and third passages 186, 188, 190. First passage 186 may be in communication with a suction pressure region of compressor 10, second passage 188 may be in communication with second and fourth passages 154, 162 in end plate 118 and third passage 190 may be in communication with fifth passage 166 in end plate 118.

Valve member 184 may be displaceable between first and second positions. In the first position (FIG. 6), first and second passages 186, 188 may be in communication with one another and isolated from third passage 190, placing second and fourth passages 154, 162 in end plate 118 in communication with a suction pressure region of compressor 10. In the second position (FIG. 7), second and third passages 188, 190 may be in communication with one another and isolated from first passage 186, placing second and fourth passages 154, 162 in end plate 118 in communication with a discharge pressure region of compressor 10.

Figure 6:
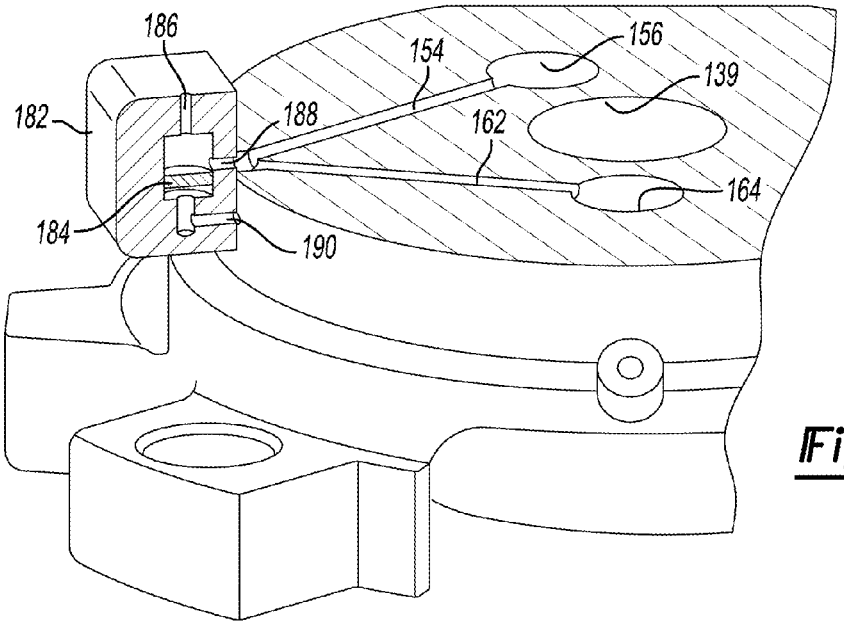
FIG. 6 is a third section view of the non-orbiting scroll and compressor output adjustment assembly of FIG. 3.
Figure 7:
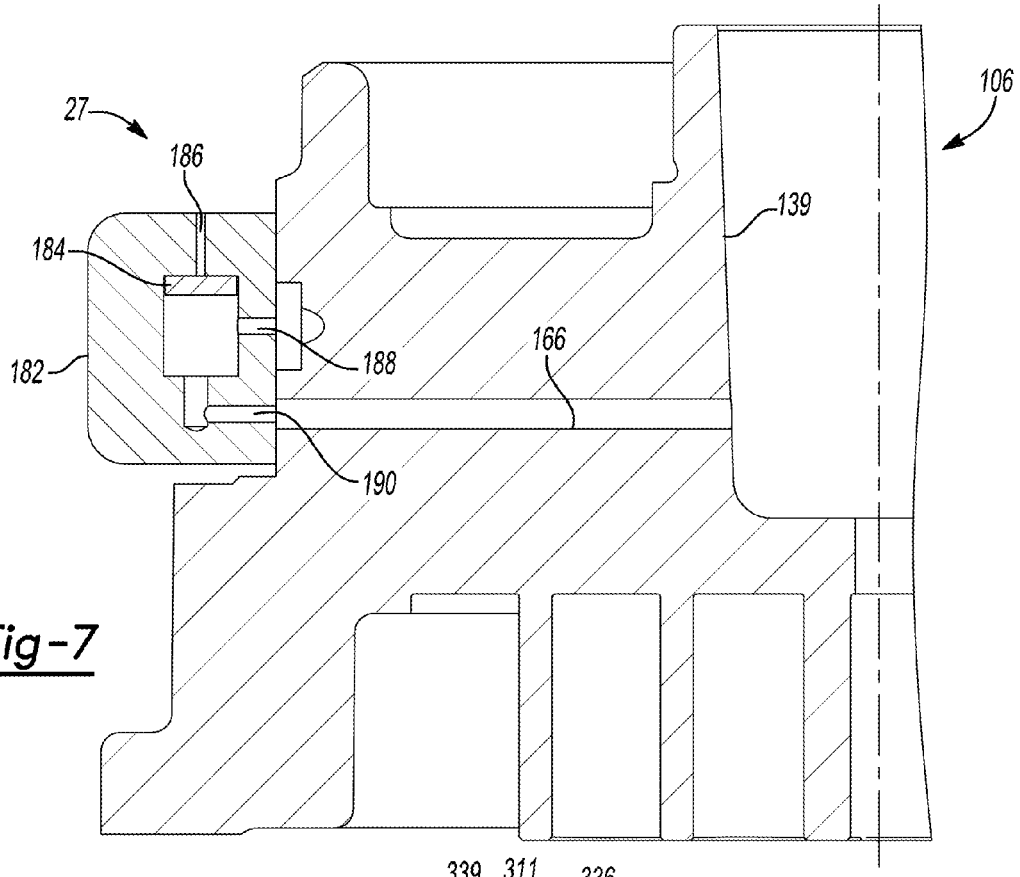
FIG. 7 is a fourth section view of the non-orbiting scroll and compressor output adjustment assembly of FIG. 3.
Figure 8:
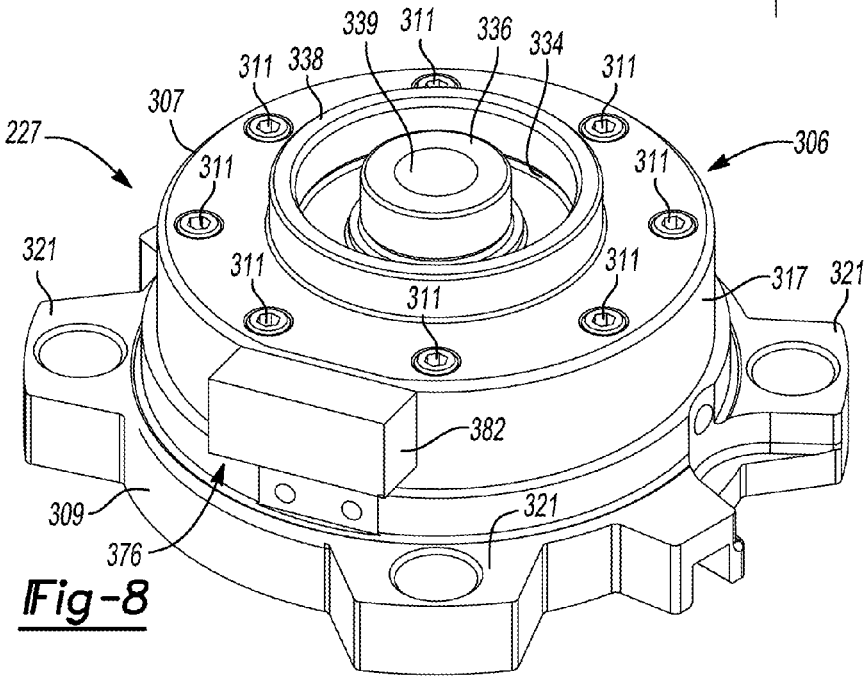
FIG. 8 is a perspective view of an alternate non-orbiting scroll and compressor output adjustment assembly according to the present disclosure.

First piston assembly 178 may be located in first chamber 145 and may include a piston 192, a seal 194 and a biasing member 196. Second piston assembly 180 may be located in second chamber 147 and may include a piston 198, a seal 200 and a biasing member 202. First and second pistons 192, 198 may be displaceable between first and second positions. More specifically, biasing members 196, 202 may urge first and second pistons 192, 198 into the first position (FIG. 4) when valve member 184 is in the first position (FIG. 6). When valve member 184 is in the second position (FIG. 7), pistons 192, 198 may be displaced to the second position (FIG. 3) by the discharge pressure provided by second and fourth passages 154, 162. Seal 194 may prevent communication between first and second passages 150, 154 when piston 192 is in both the first and second positions. Seal 200 may prevent communication between third and fourth passages 158, 162 when piston 198 is in both the first and second positions.

Figure 3:
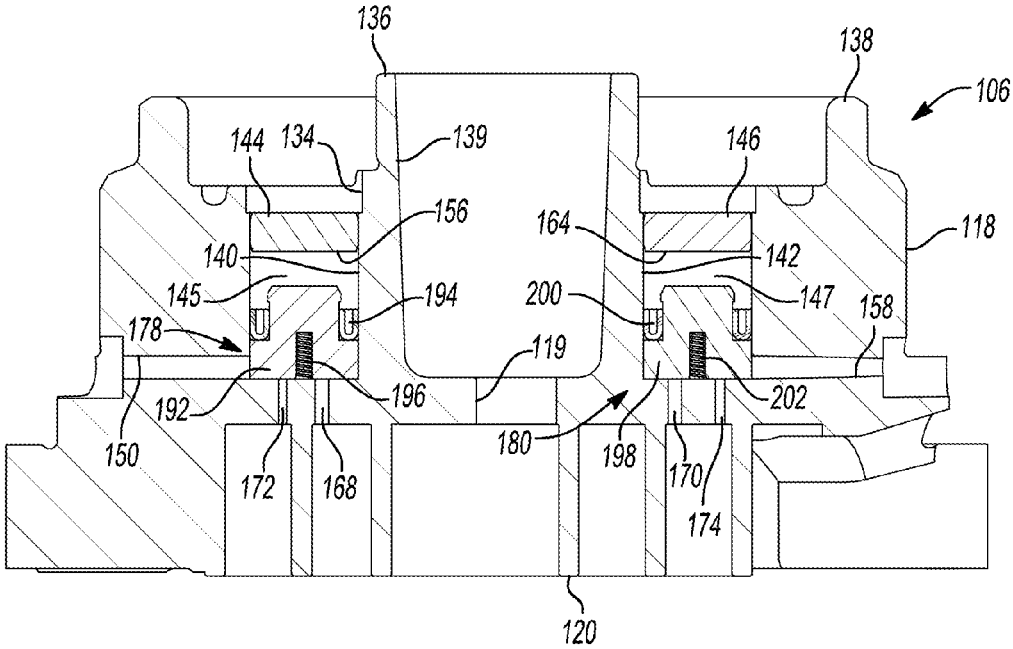
FIG. 3 is a first section view of a non-orbiting scroll and compressor output adjustment assembly of the compressor of FIG. 1.
Figure 4:
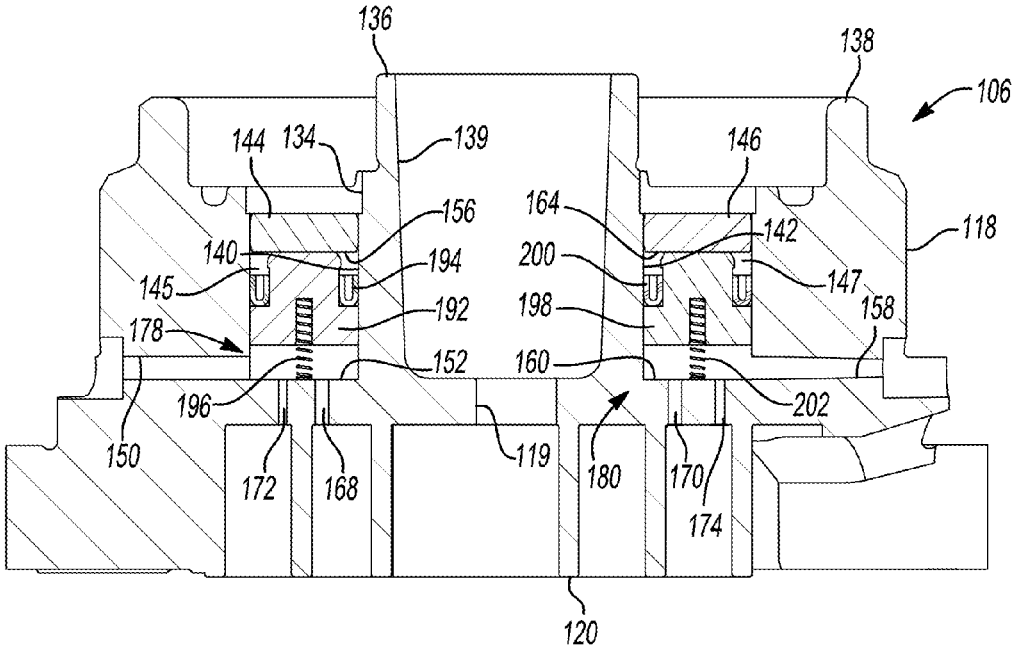
FIG. 4 is second section view of the non-orbiting scroll and compressor output adjustment assembly of FIG. 3.
Figure 5:
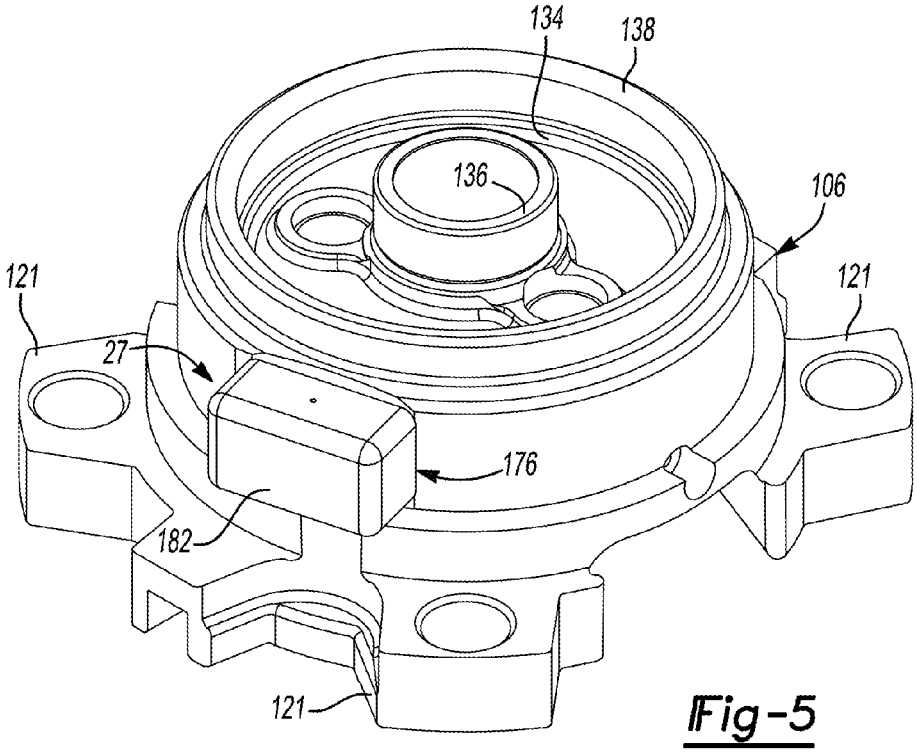
FIG. 5 is a perspective view of the non-orbiting scroll and compressor output adjustment assembly of FIG. 3.

As seen in FIG. 3, when pistons 192, 198 are in the second position, piston 192 may seal ports 168, 172 from communication with first passage 150 and piston 198 may seal ports 170, 174 from communication with third passage 158. When pistons 192, 198 are in the first position, seen in FIG. 4, piston 192 may be displaced away from ports 168, 172 providing communication between ports 168, 172 and first passage 150 and piston 198 may be displaced from ports 170, 174 providing communication between ports 170, 174 and third passage 158. Therefore, when pistons 192, 198 are in the first position, ports 168, 170, 172, 174 may each be in communication with a suction pressure region of compressor 10, reducing an operating capacity of compressor 10. Gas may flow from the ports 168, 170, 172, 174 to the suction pressure region of compressor 10 when pistons 192, 198 are in the first position. Additionally, gas may flow from port 168 to port 172 when piston 192 is in the first position and gas may flow from port 170 to port 174 when piston 198 is in the first position.

Figure 20:
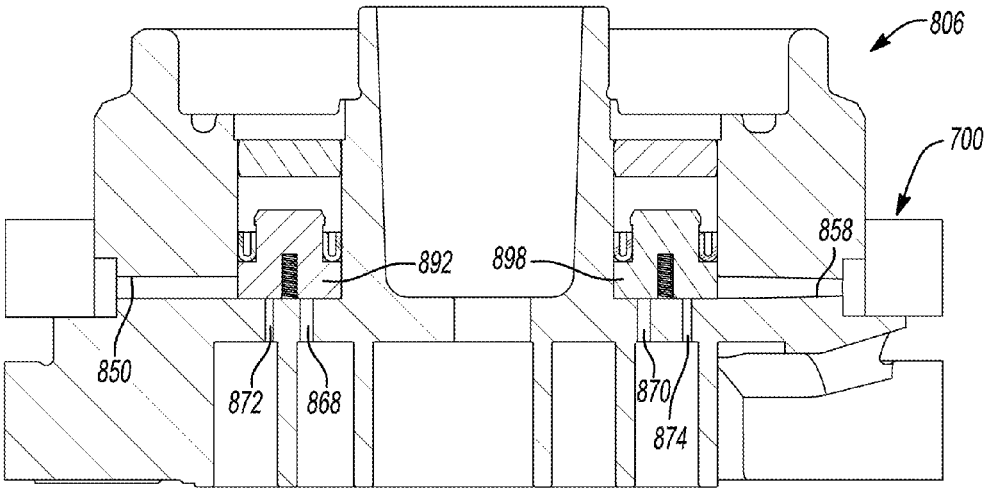
FIG. 20 is a first section view of an alternate non-orbiting scroll and compressor output adjustment assembly according to the present disclosure.
Figure 21:
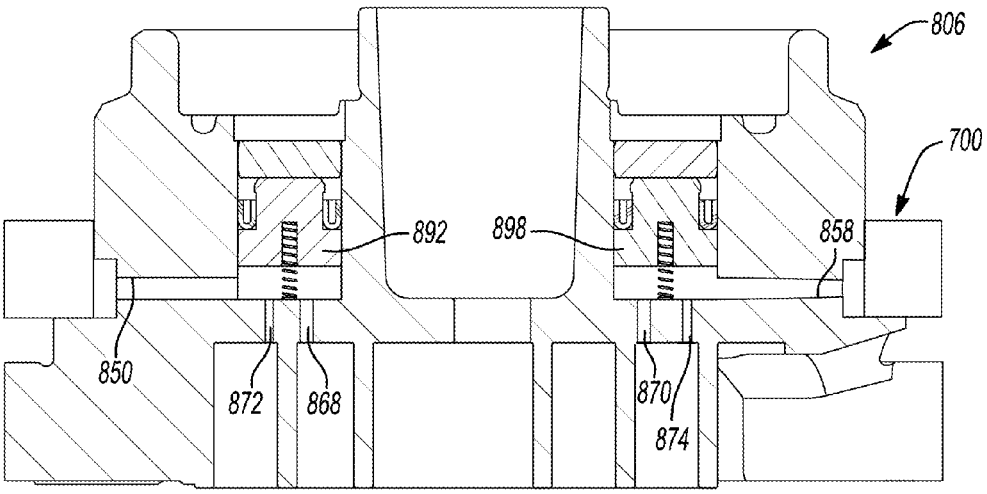
FIG. 21 is a second section view of the non-orbiting scroll and compressor output adjustment assembly of FIG. 20.

In an alternate arrangement, seen in FIGS. 20 and 21, a vapor injection system 700 is included in the compressor output adjustment assembly. Non-orbiting scroll member 806 may be generally similar to non-orbiting scroll 106. Therefore, non-orbiting scroll 806 and the compressor adjustment assembly will not be described in detail with the understanding that the description above applies equally, with exceptions indicated below.

Vapor injection system 700 may be in communication with first and third passages 850, 858 and with a vapor source from, for example, a heat exchanger or a flash tank in communication with the compressor. When pistons 892, 898 are in the first position, seen in FIG. 21, piston 892 may be displaced away from ports 868, 872 providing communication between ports 868, 872 and first passage 850 and piston 898 may be displaced from ports 870, 874 providing communication between ports 870, 874 and third passage 858. Therefore, when pistons 892, 898 are in the first position, ports 868, 870, 872, 874 may each be in communication with the vapor source from vapor injection system 700, increasing an operating capacity of the compressor.

Figure 11:
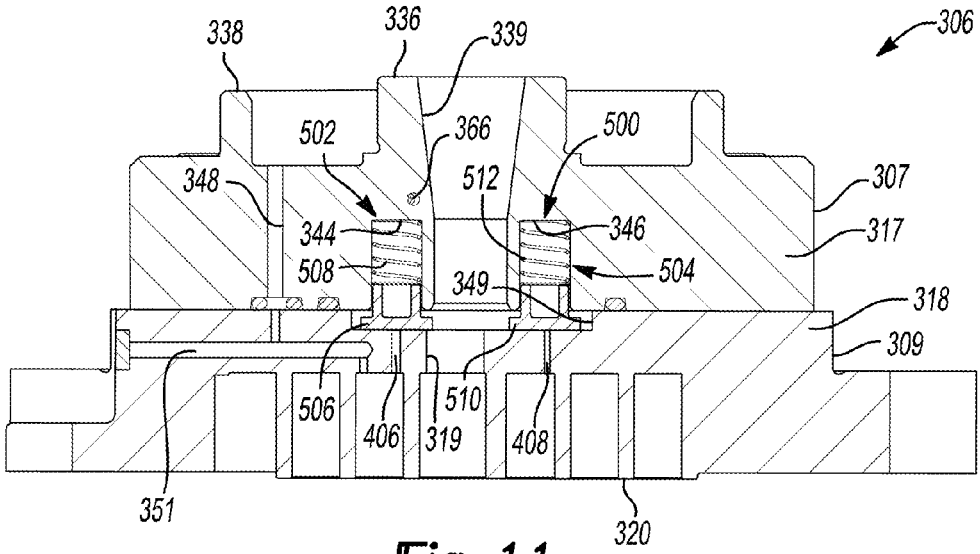
FIG. 11 is a third section view of the non-orbiting scroll and compressor output adjustment assembly of FIG. 8.
Figure 12:
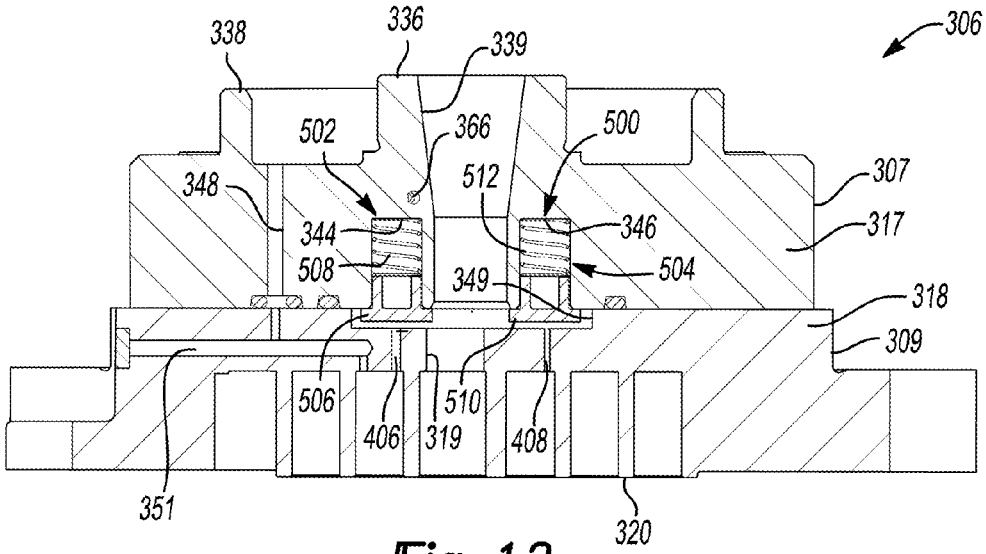
FIG. 12 is a fourth section view of the non-orbiting scroll and compressor output adjustment assembly of FIG. 8.
Figure 13:
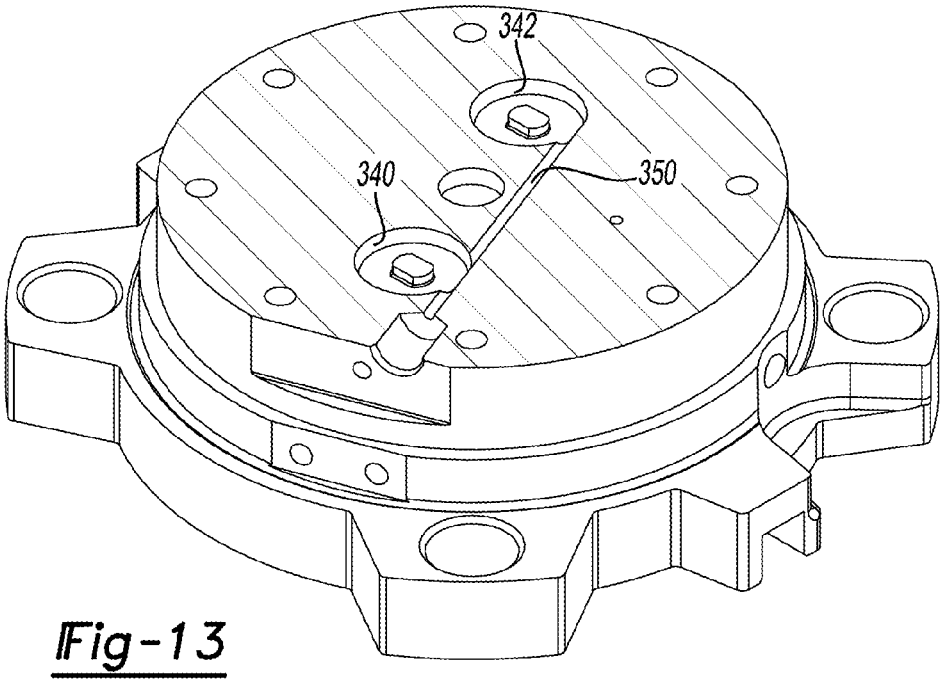
FIG. 13 is a fifth section view of the non-orbiting scroll and compressor output adjustment assembly of FIG. 8.
Figure 14:
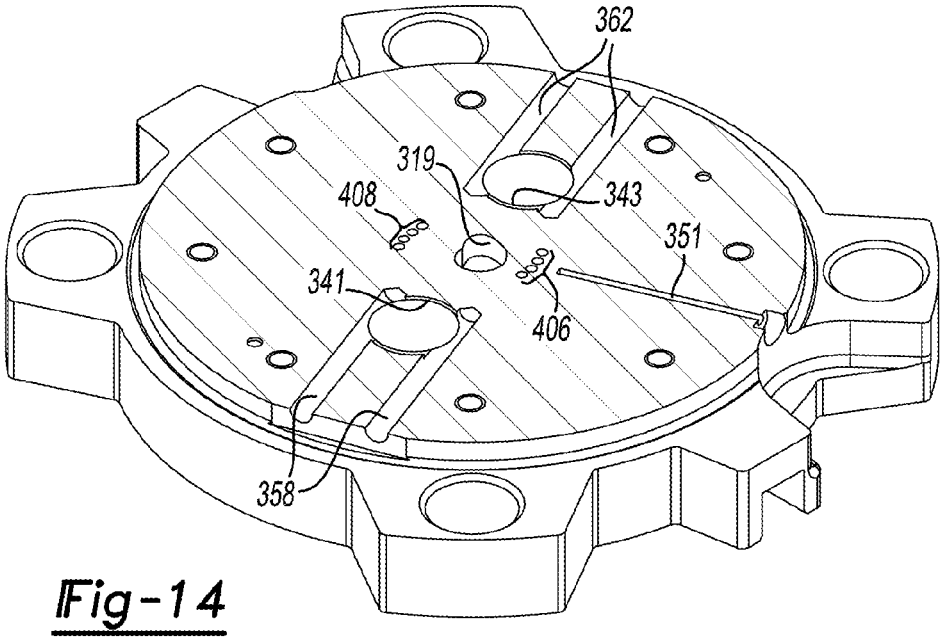
FIG. 14 is a sixth section view of the non-orbiting scroll and compressor output adjustment assembly of FIG. 8.
Figure 15:
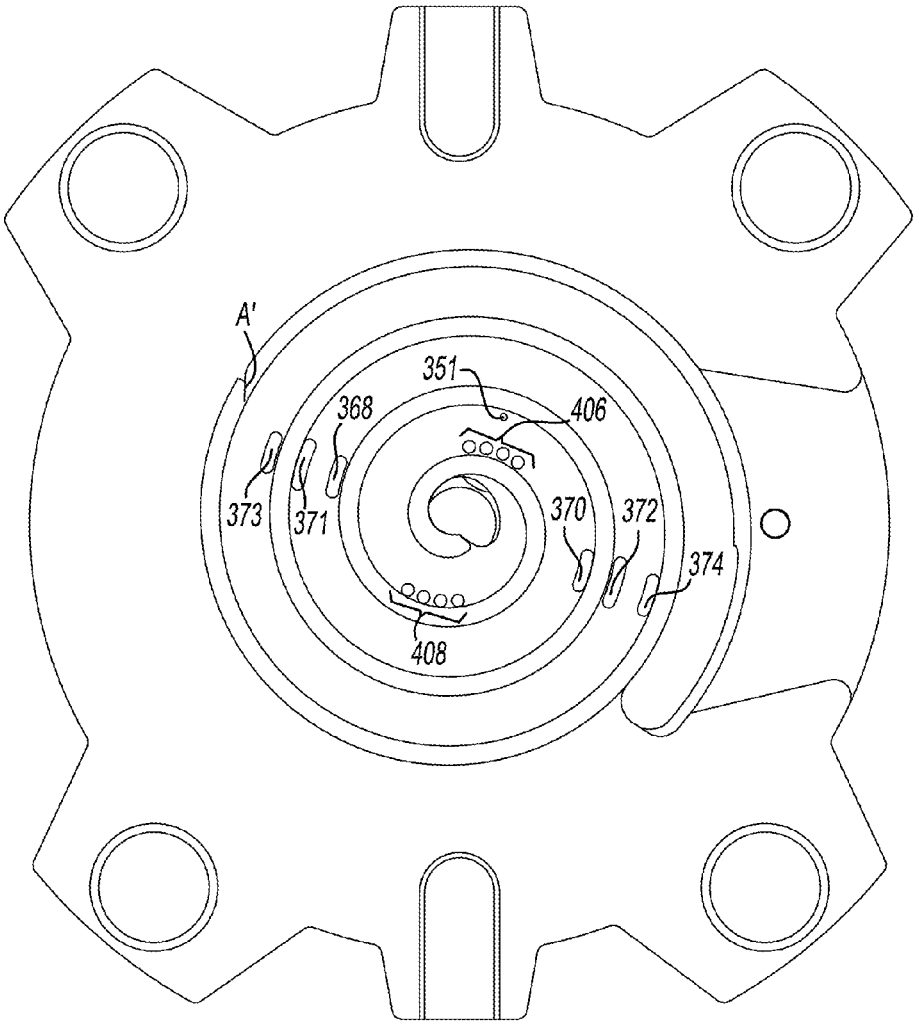
FIG. 15 is a plan view of the non-orbiting scroll of FIG. 8.

With reference to FIGS. 8-15, an alternate non-orbiting scroll 306 may be incorporated into compressor 10. Non-orbiting scroll 306 may include first and second members 307, 309. First member 307 may be fixed to second member 309 using fasteners 311. First member 307 may include a first end plate portion 317 and may include an annular recess 334 in the upper surface thereof defined by parallel coaxial side walls 336, 338. Side wall 336 may for a discharge passage 339. First end plate portion 317 may include first and second discrete recesses 340, 342 (FIGS. 9 and 10) and third and fourth discrete recesses 344, 346 (FIGS. 11 and 12). An aperture 348 (seen in FIGS. 11 and 12) may extend through first end plate portion 317 and into annular recess 334.

Second member 309 may include a second end plate portion 318 having a spiral wrap 320 on a lower surface thereof, a discharge passage 319 extending through second end plate portion 318, and a series of radially outwardly extending flanged portions 321. Spiral wrap 320 may form a meshing engagement with a wrap of an orbiting scroll similar to orbiting scroll 104 to create a series of pockets.

Second end plate portion 318 may further include first and second discrete recesses 341, 343 (FIGS. 9 and 10) and a central recess 349 (FIGS. 11 and 12) having discharge passage 319 passing therethrough. When first and second members 307, 309 are assembled to form non-orbiting scroll 306, first and second recesses 340, 342 in first member 307 may be aligned with first and second recesses 341, 343 in second member 309 to form first and second chambers 345, 347. First and second chambers 345, 347 may be isolated from annular recess 334. An aperture 351 (seen in FIGS. 11 and 12) may extend through second end plate portion 318 and may be in communication with aperture 348 in first member 307 to provide pressure biasing for a floating seal assembly generally similar to that discussed above for seal assembly 20.

A first passage 350 (seen in FIG. 13) may extend radially through first end plate portion 317 from an outer surface of non-orbiting scroll 306 to first and second recesses 340, 342. A pair of second passages 358 may extend radially through second end plate portion 318 from first recess 341 to an outer surface of non-orbiting scroll 306 and a pair of third passages 362 may extend radially through second end plate portion 318 from second recess 343 to an outer surface of non-orbiting scroll 306. Second and third passages 358, 362 may be in communication with a suction pressure region. A fourth passage 366 (FIGS. 11 and 12) may extend radially through first end plate portion 317 from a discharge pressure region to an outer surface of non-orbiting scroll 306. For example, fourth passage 366 may extend from discharge passage 339 to an outer surface of non-orbiting scroll 306. First and fourth passages 350, 366 may be in communication with modulation assembly 227, as discussed below.

Second end plate portion 318 may further include first, second, third, fourth, fifth, and sixth modulation ports 368, 370, 371, 372, 373, 374, as well as first and second variable volume ratio (VVR) porting 406, 408. First, third, and fifth modulation ports 368, 371, 373 may be in communication with first chamber 341 and second, fourth, and sixth modulation ports 370, 372, 374 may be in communication with second chamber 343. First and second ports 368, 370 may generally define a modulated compressor capacity.

Ports 368, 370 may each be located in one of the pockets located at least seven hundred and twenty degrees radially inward from a starting point (A') of wrap 320. Port 368 may be located radially inward relative to ports 371, 373 and port 370 may be located radially inward relative to ports 372, 374. Due to the greater inward location of ports 368, 370 along wrap 320, ports 371, 372, 373, 374 may each form an auxiliary port for preventing compression in pockets radially outward from ports 368, 370 when ports 368, 370, 371, 372, 373, 374 are exposed to a suction pressure region.

First and second VVR porting 406, 408 may be located radially inward relative to ports 368, 370, 371, 372, 373, 374 and relative to aperture 351. First and second VVR porting 406, 408 may be in communication with one of the pockets formed by wraps 310, 320 (FIGS. 16-19) and with central recess 349. Therefore, first and second VVR porting 406, 408 may be in communication with discharge passage 339.

Modulation assembly 227 may include a valve assembly 376 and first and second piston assemblies 378, 380. Valve assembly 376 may include a solenoid valve having a housing 382 having a valve member (not shown) disposed therein.

First piston assembly 378 may be located in first chamber 345 and may include a piston 392, a seal 394 and a biasing member 396. Second piston assembly 380 may be located in second chamber 347 and may include a piston 398, a seal 400 and a biasing member 402. First and second pistons 392, 398 may be displaceable between first and second positions. More specifically, biasing members 396, 402 may urge first and second pistons 392, 398 into the first position (FIG. 10) when valve assembly 376 vents recesses 340, 342. Valve assembly 376 may selectively vent recesses 340, 342 to a suction pressure region. Valve assembly 376 may additionally be in communication with first passage 350 and fourth passage 366. Valve assembly 376 may selectively provide communication between first passage 350 and a discharge pressure region via fourth passage 366. When valve assembly 376 provides communication between first passage 350 and the discharge pressure region, pistons 392, 398 may be displaced to the second position (FIG. 9) by the discharge pressure provided by first passage 350. Seal 394 may prevent communication between first passage 350 and the second passages 358 when piston 392 is in both the first and second positions. Seal 400 may prevent communication between the first passage 350 and third passages 362 when piston 398 is in both the first and second positions.

Figure 9:
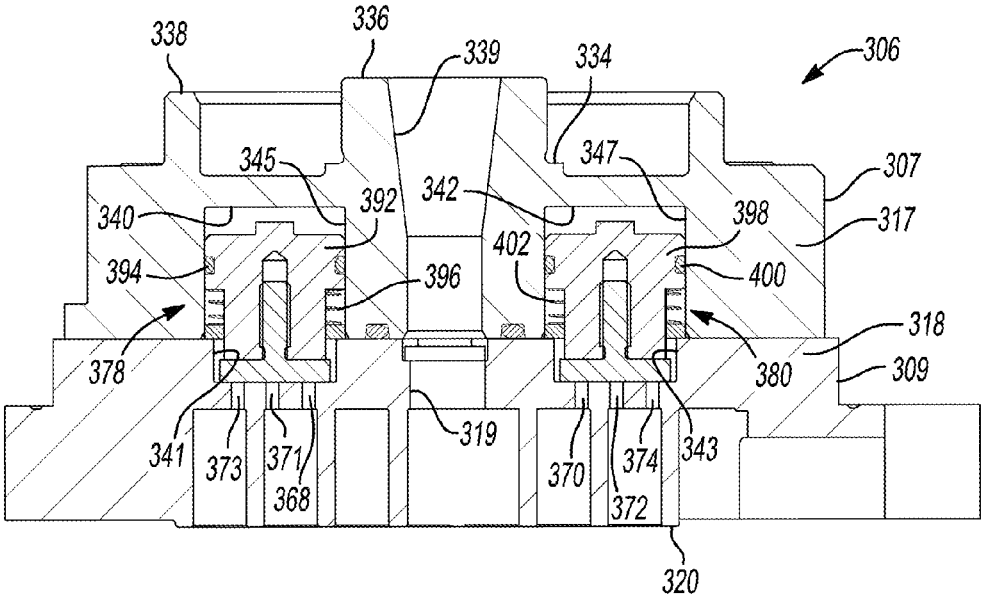
FIG. 9 is a first section view of the non-orbiting scroll and compressor output adjustment assembly of FIG. 8.
Figure 10:
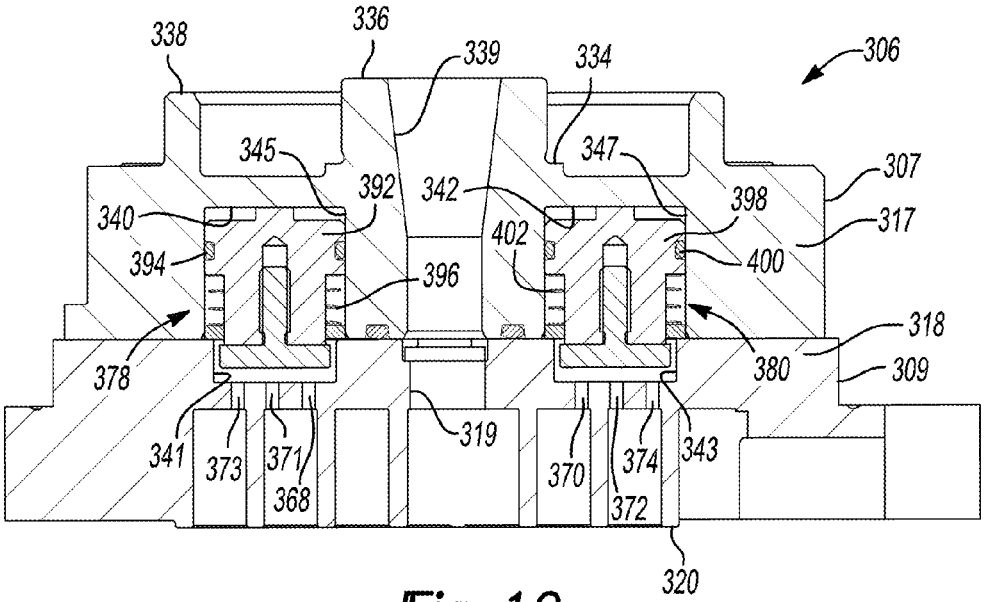
FIG. 10 is a second section view of the non-orbiting scroll and compressor output adjustment assembly of FIG. 8.

As seen in FIG. 9, when pistons 392, 398 are in the second position, piston 392 may seal ports 368, 371, 373 from communication with second passages 358 and piston 398 may seal ports 370, 372, 374 from communication with third passages 362. When pistons 392, 398 are in the first position, seen in FIG. 10, piston 392 may be displaced from ports 368, 371, 373 providing communication between ports 368, 371, 373 and second passages 358 and piston 398 may be displaced from ports 370, 372, 374 providing communication between ports 370, 372, 374 and third passages 362. Therefore, when pistons 392, 398 are in the first position, ports 368, 370, 371, 372, 373, 374 may each be in communication with a suction pressure region, reducing a compressor operating capacity. Additionally, when pistons 392, 398 are in the first position, one or more of ports 368, 370, 371, 372, 373, 374 may provide gas flow to another of ports 368, 370, 371, 372, 373, 374 operating at a lower pressure.

As seen in FIGS. 11 and 12 a VVR assembly 500 may selectively provide communication between VVR porting 406, 408 and discharge passage 339. VVR assembly 500 may include first and second piston assemblies 502, 504. First piston assembly 502 may include a piston 506 and a biasing member 508 such as a spring. Second piston assembly 504 may include a piston 510 and a biasing member 512 such as a spring. Biasing members 508, 512 may urge pistons 506, 510 into a first position where pistons 506, 510 are engaged with second end plate portion 318 to seal VVR porting 406, 408. When pressure from VVR porting 406, 408 exceeds a predetermined level, a force applied to pistons 506, 510 by the gas in VVR porting 406, 408 may exceed the force applied by biasing members 508, 512 and pistons 506, 510 may be displaced to a second position where VVR porting 406, 408 is in communication with discharge passage 339.

Figure 16:
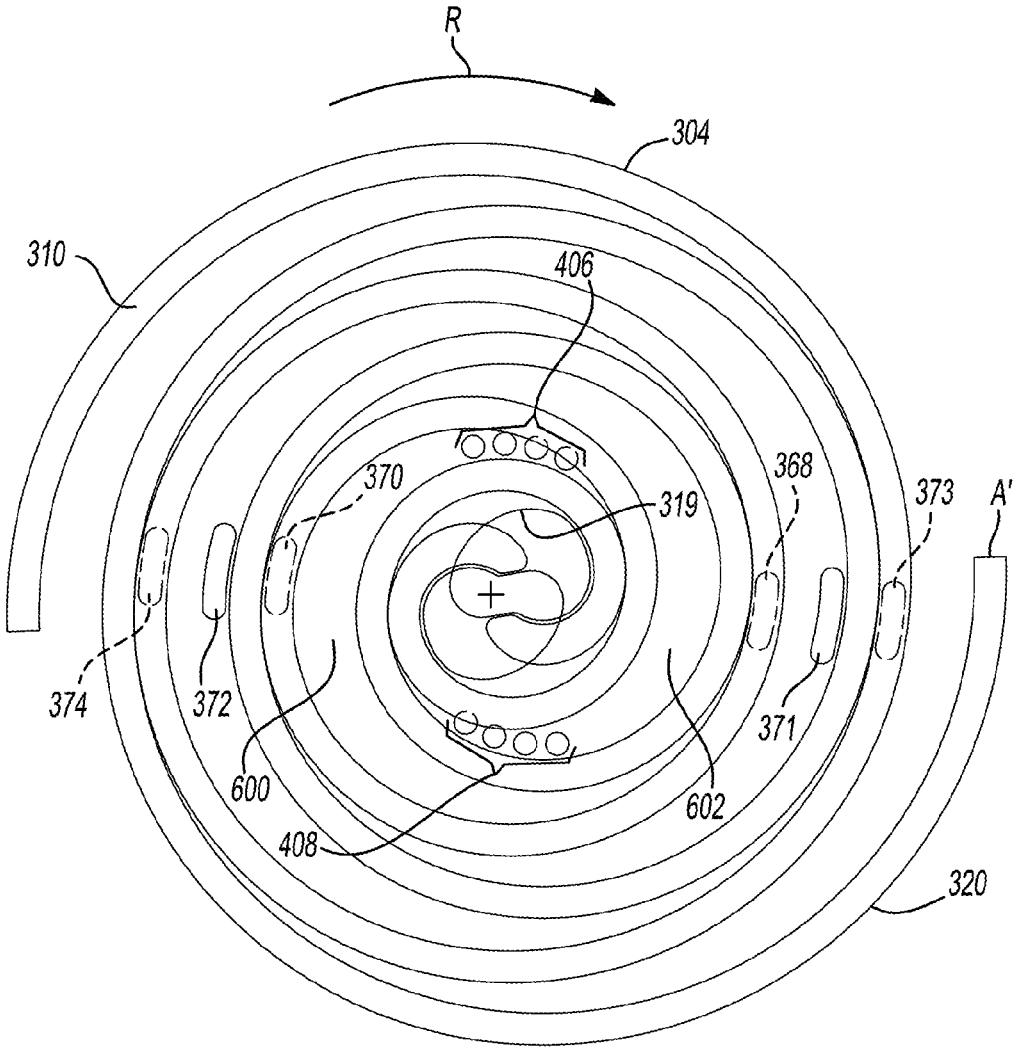
FIG. 16 is a schematic illustration of a first scroll orientation according to the present disclosure.

As seen in FIGS. 16-19 a portion of a compression cycle is illustrated to show operation of ports 368, 370, 371, 372, 373, 374 and VVR porting 406, 408. In FIG. 16, orbiting scroll 304 is illustrated in a first position where first modulated capacity pockets 600, 602 are defined. The first modulated capacity pockets 600, 602 may generally be defined as the radially outermost compression pockets that are disposed radially inwardly relative to port 368 and isolated from port 368 from the time the first modulated capacity pockets 600, 602 are formed until the volume in the first modulated capacity pockets 600, 602 is discharged through discharge passage 319. Thus, the volume in the first modulated capacity pockets 600, 602 may be isolated from port 368 during a remainder of a compression cycle associated therewith. The volume of the first modulated capacity pockets 600, 602 may be at a maximum volume when orbiting scroll 304 is in the first position and may be continuously compressed until being discharged through discharge passage 319.

Spiral wrap 310 of orbiting scroll 304 may abut an outer radial surface of spiral wrap 320 at a first location and may abut the inner radial surface of spiral wrap 320 at a second location generally opposite the first location when orbiting scroll 304 is in the first position. Port 368 may extend at least twenty degrees along spiral wrap 310 in a rotational direction (R) of the drive shaft starting at a first angular position corresponding to the first location when orbiting scroll 304 is in the first position. Port 368 may be sealed by spiral wrap 310 when orbiting scroll 304 is in the first position. A portion of port 370 may be in communication with the first modulated capacity pocket 602 when orbiting scroll 304 is in the first position.

Figure 17:
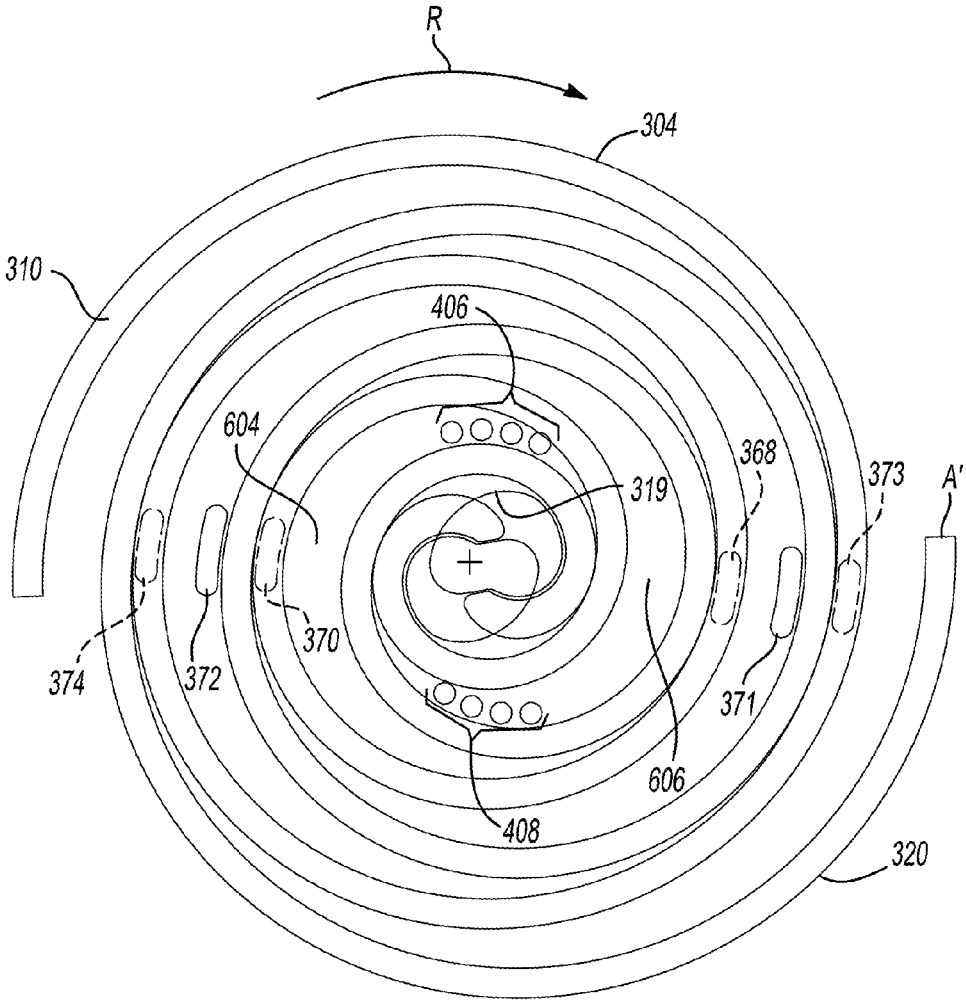
FIG. 17 is a schematic illustration of a second scroll orientation according to the present disclosure.

In FIG. 17, orbiting scroll 304 is illustrated in a second position where second modulated capacity pockets 604, 606 are defined. In the second position, the second modulated capacity pockets 604, 606 may generally be defined as the radially outermost compression pockets that are disposed radially inwardly relative to ports 368, 370 and isolated from ports 368, 370 from the time the orbiting scroll 304 is in the second position until the volume in the second modulated capacity pockets is discharged through discharge passage 319. The second modulated capacity pockets 604, 606 may correspond to the first modulated capacity pockets 600, 602 after compression resulting from orbiting scroll 304 travelling from the first position to the second position. For example, the compression from the first position to the second position may correspond to approximately twenty degrees of rotation of the drive shaft.

Spiral wrap 310 of orbiting scroll 304 may abut an outer radial surface of spiral wrap 320 at a third location and may abut the an inner radial surface of spiral wrap 320 at a fourth location generally opposite the third location when orbiting scroll 304 is in the second position. Port 370 may extend at least twenty degrees along spiral wrap 310 generally opposite a rotational direction (R) of the drive shaft starting at a second angular position corresponding to the fourth location when orbiting scroll 304 is in the second position. Port 370 may be sealed by spiral wrap 310 when orbiting scroll 304 is in the second position.

As seen in FIGS. 16 and 17, each of the pockets located radially outward from the first and second modulated capacity pockets 600, 602, 604, 606 may always be in communication with at least one of ports 368, 370, 371, 372, 373, 374.

Figure 18:
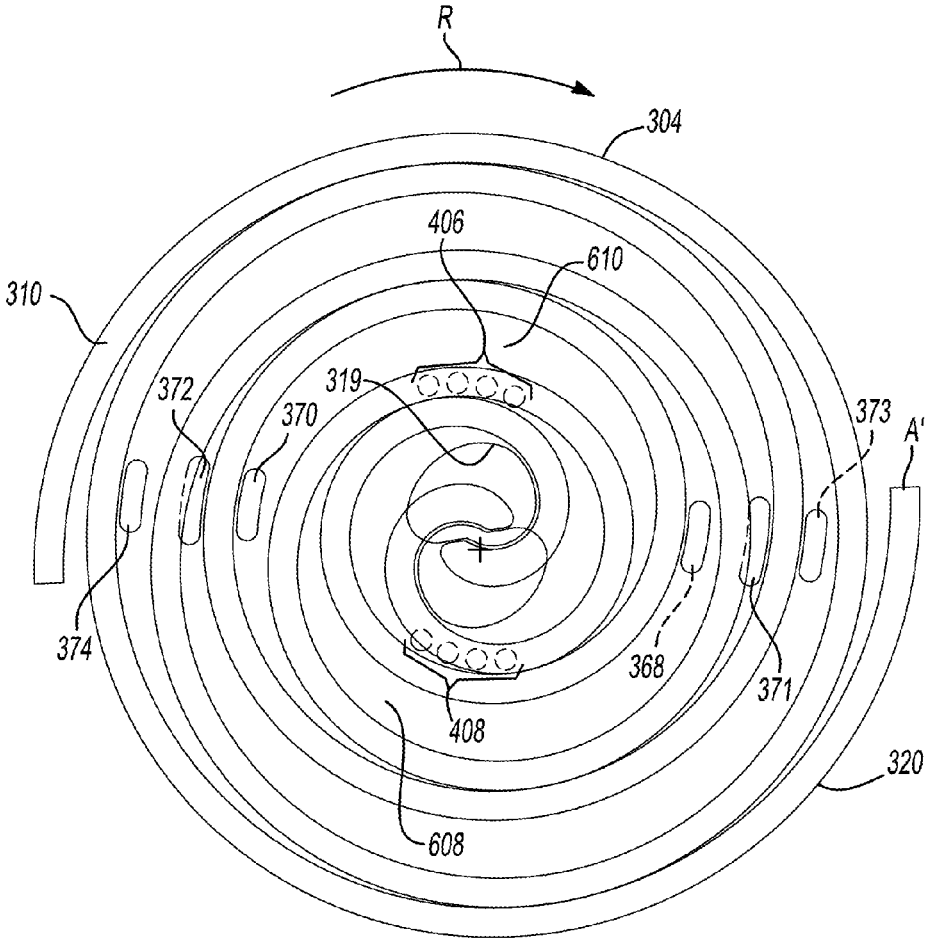
FIG. 18 is a schematic illustration of a third scroll orientation according to the present disclosure.
Figure 19:
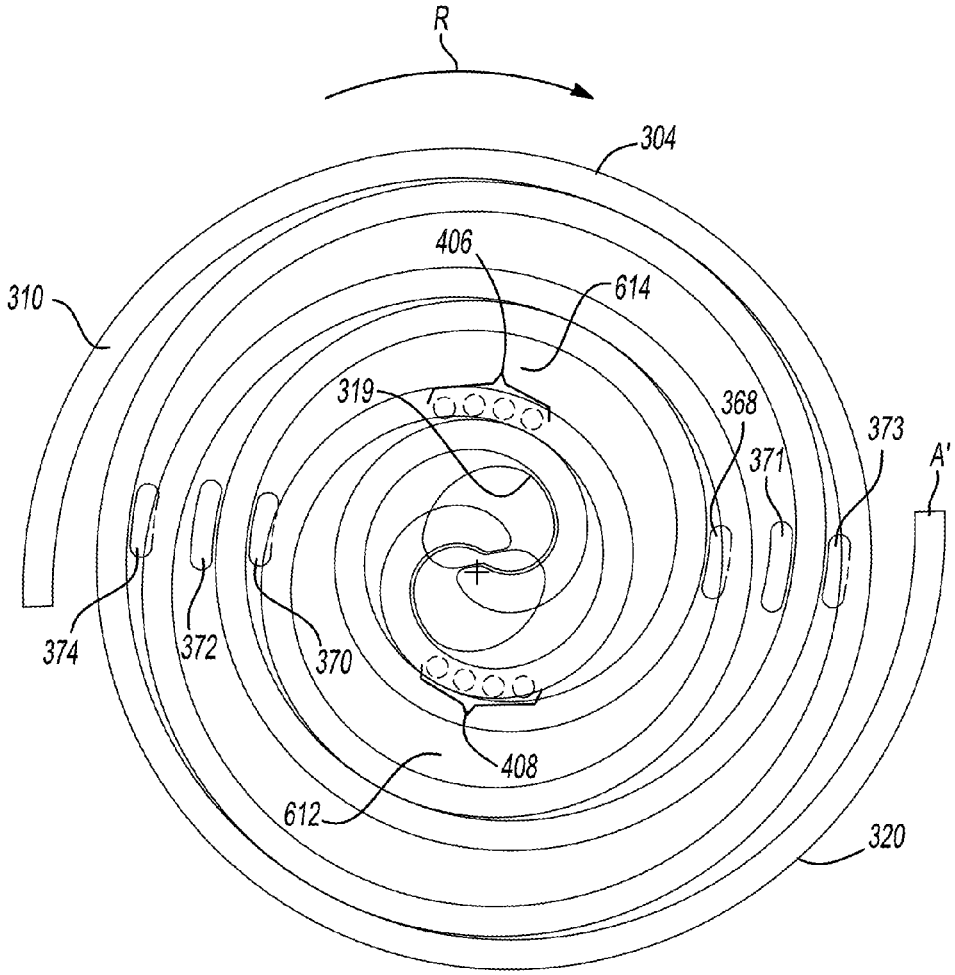
FIG. 19 is a schematic illustration of a fourth scroll orientation according to the present disclosure.

Referring to FIGS. 18 and 19, VVR operation for VVR porting 406, 408 is illustrated. In FIG. 18, orbiting scroll 304 is illustrated in a third position where first VVR pockets 608, 610 are defined. The first VVR pockets 608, 610 may generally be defined as the radially innermost compression pockets that are disposed radially outwardly relative to VVR porting 406 and isolated from VVR porting 406 from the time a compression cycle is started until the first VVR pockets 608, 610 are formed. Thus, the first VVR pockets 608, 610 may be in communication with VVR porting 406 during a remainder of a compression cycle. The volume of the first VVR pockets 608, 610 may be at a maximum volume when orbiting scroll 304 is in the third position and may be continuously compressed until being discharged through discharge passage 319.

Spiral wrap 310 of orbiting scroll 304 may abut an outer radial surface of spiral wrap 320 at a fifth location and may abut the inner radial surface of spiral wrap 320 at a sixth location generally opposite the fifth location when orbiting scroll 304 is in the third position. VVR porting 406 may extend at least twenty degrees along spiral wrap 310 in a rotational direction (R) of the drive shaft starting at an angular position corresponding to the fifth location when orbiting scroll 304 is in the third position.

In FIG. 19, and orbiting scroll 304 is illustrated in a fourth position where second VVR pockets 612, 614 are defined. In the fourth position, the second VVR pockets 612, 614 may generally be defined as the radially innermost compression pockets that are disposed radially outwardly relative to VVR porting 408 and isolated from VVR porting 408 from the time a compression cycle is started until the second VVR pockets 612, 614 are formed. The second VVR pockets 612, 614 may correspond to the first VVR pockets 608, 610 after compression resulting from orbiting scroll 304 travelling from the third position to the fourth position. For example, the compression from the third position to the fourth position may correspond to approximately forty degrees of rotation of the drive shaft. A portion of VVR porting 406 may be in communication with the second VVR pockets 612, 614 when orbiting scroll 304 is in the fourth position.

Spiral wrap 310 of orbiting scroll 304 may abut an outer radial surface of spiral wrap 320 at a seventh location and may abut the an inner radial surface of spiral wrap 320 at an eighth location generally opposite the seventh location when orbiting scroll 304 is in the fourth position. VVR porting 408 may extend at least twenty degrees along spiral wrap 310 generally opposite a rotational direction (R) of the drive shaft starting at a fourth angular position corresponding to the eighth location when orbiting scroll 304 is in the fourth position.

The terms "first", "second", etc. are used throughout the description for clarity only and are not intended to limit similar terms in the claims.

What is claimed is:

1. A compressor comprising:

a housing;

a first scroll member positioned within said housing, having a first spiral wrap extending therefrom and including a first end plate portion coupled to a second end plate portion, said first end plate portion and said second end plate portion defining a discharge passage;

a second scroll member positioned within said housing and including a second spiral wrap engaged with said first spiral wrap; and a valve assembly supported by at least one of said first end plate portion and said second end plate portion at a location radially outward from said discharge passage and in communication with said discharge passage via a passage, said valve assembly forming a variable volume ratio valve assembly;

wherein said second end plate portion defines a first variable volume ratio passage in communication with a first pocket formed by said first and second spiral wraps and said variable volume ratio valve assembly includes a first variable volume ratio valve overlying said first variable volume ratio passage and displaceable between open and closed positions, said first variable volume ratio passage providing communication between said first pocket and said discharge passage when said first variable volume ratio valve is in the open position and said first variable volume ratio passage being isolated from said discharge passage when said first variable volume ratio valve is in the closed position; and wherein said second end plate portion defines a second variable volume ratio passage in communication with a second pocket formed by said first and second spiral wraps and said variable volume ratio valve assembly includes a second variable volume ratio valve overlying said second variable volume ratio passage and displaceable between open and closed positions independently from said first variable volume ratio valve, said second variable volume ratio passage providing communication between said second pocket and said discharge passage when said second variable volume ratio valve is in the open position and said second variable volume ratio passage being isolated from said discharge passage when said second variable volume ratio valve is in the closed position.

2. The compressor of claim 1, further comprising a drive shaft engaged with said second scroll member to drive orbital displacement of said second scroll member relative to said first scroll member.

3. The compressor of claim 1, further comprising a recess defined in said first end plate portion.

4. The compressor of claim 3, wherein said first and second end plate portions define a biasing passage extending therethrough and providing communication between said recess and a pocket formed by said first and second spiral wraps.

5. The compressor of claim 4, further comprising a seal engaged with said first end plate portion.

6. The compressor of claim 5, wherein said seal surrounds said biasing passage.

7. The compressor of claim 1, wherein said second end plate portion defines multiple variable volume ratio passages including said first variable volume ratio passage in communication with said first variable volume ratio valve and defines multiple variable volume ratio passages including said second variable volume ratio passage in communication with said second variable volume ratio valve.

8. The compressor of claim 1, further comprising a capacity modulation valve assembly supported by at least one of said first end plate portion and said second end plate portion at a location radially outward from said variable volume ratio valve assembly.

9. The compressor of claim 1, wherein said valve assembly is in communication with a suction pressure region of the compressor and forms a capacity modulation valve assembly.

10. The compressor of claim 9, wherein said second end plate portion defines a first capacity modulation passage in communication with a third pocket formed by said first and second spiral wraps and said capacity modulation valve assembly includes a first capacity modulation valve overlying said first capacity modulation passage and displaceable between open and closed positions, said first capacity modulation passage providing communication between said third pocket and said suction pressure region when said first capacity modulation valve is in the open position and said first capacity modulation passage being isolated from said suction pressure region when said first capacity modulation valve is in the closed position.

11. The compressor of claim 10, wherein said second end plate portion defines a second capacity modulation passage in communication with a fourth pocket formed by said first and second spiral wraps and said capacity modulation valve assembly includes a second capacity modulation valve overlying said second capacity modulation passage and displaceable between open and closed positions independently from said first capacity modulation valve, said second capacity modulation passage providing communication between said fourth pocket and said suction pressure region when said second capacity modulation valve is in the open position and said second capacity modulation passage being isolated from said suction pressure region when said second capacity modulation valve is in the closed position.

12. A compressor comprising:

a housing;

a first scroll member positioned within said housing, having a first spiral wrap extending therefrom, including a first end plate portion coupled to a second end plate portion, and defining an intermediate passage, said first end plate portion and said second end plate portion defining a discharge passage;

a second scroll member supported within said housing and including second spiral wrap engaged with said first spiral wrap and defining a discharge pocket in communication with said discharge passage and an intermediate pocket in communication with said intermediate passage; and a valve assembly in communication with said discharge passage via a passage and in communication with said intermediate passage, said valve assembly forming a variable volume ratio valve assembly;

wherein said second end plate portion defines said intermediate passage and said intermediate passage forms a first variable volume ratio passage in communication with a first pocket formed by said first and second spiral wraps and said variable volume ratio valve assembly includes a first variable volume ratio valve overlying said first variable volume ratio passage and displaceable between open and closed positions, said first variable volume ratio passage providing communication between said first pocket and said discharge passage when said first variable volume ratio valve is in the open position and said first variable volume ratio passage being isolated from said discharge passage when said first variable volume ratio valve is in the closed position; and wherein said second end plate portion defines a second variable volume ratio passage in communication with a second pocket formed by said first and second spiral wraps and said variable volume ratio valve assembly includes a second variable volume ratio valve overlying said second variable volume ratio passage and displaceable between open and closed positions independently from said first variable volume ratio valve, said second variable volume ratio passage providing communication between said second pocket and said discharge passage when said second variable volume ratio valve is in the open position and said second variable volume ratio passage being isolated from said discharge passage when said second variable volume ratio valve is in the closed position.

13. The compressor of claim 12, further comprising a drive shaft engaged with said second scroll member to drive orbital displacement of said second scroll member relative to said first scroll member.

14. The compressor of claim 12, further comprising a recess defined in said first end plate portion.

15. The compressor of claim 14, wherein said first and second end plate portions define a biasing passage extending therethrough and providing communication between said recess and a pocket formed by said first and second spiral wraps.

16. The compressor of claim 15, further comprising a seal engaged with said first end plate portion.

17. The compressor of claim 16, wherein said seal surrounds said biasing passage.

18. The compressor of claim 12, wherein said second end plate portion defines multiple variable volume ratio passages including said first variable volume ratio passage in communication with said first variable volume ratio valve and defines multiple variable volume ratio passages including said second variable volume ratio passage in communication with said second variable volume ratio valve.

19. The compressor of claim 12, further comprising a capacity modulation valve assembly supported by at least one of said first end plate portion and said second end plate portion at a location radially outward from said variable volume ratio valve assembly.

20. The compressor of claim 12, wherein said valve assembly is in communication with a suction pressure region of the compressor and forms a capacity modulation valve assembly.

21. The compressor of claim 20, wherein said second end plate portion defines said intermediate passage and said intermediate passage forms a first capacity modulation passage in communication with a third pocket formed by said first and second spiral wraps and said capacity modulation valve assembly includes a first capacity modulation valve overlying said first capacity modulation passage and displaceable between open and closed positions, said first capacity modulation passage providing communication between said third pocket and said suction pressure region when said first capacity modulation valve is in the open position and said first capacity modulation passage being isolated from said suction pressure region when said first capacity modulation valve is in the closed position.

22. The compressor of claim 21, wherein said second end plate portion defines a second capacity modulation passage in communication with a fourth pocket formed by said first and second spiral wraps and said capacity modulation valve assembly includes a second capacity modulation valve overlying said second capacity modulation passage and displaceable between open and closed positions independently from said first capacity modulation valve, said second capacity modulation passage providing communication between said fourth pocket and said suction pressure region when said second capacity modulation valve is in the open position and said second capacity modulation passage being isolated from said suction pressure region when said second capacity modulation valve is in the closed position.

23. A compressor comprising:

a housing;

a first scroll member supported within said housing and including a first end plate and a first spiral wrap extending from said first end plate, said first end plate defining a discharge passage in communication with a discharge pressure region of the compressor, a first variable volume ratio passage, and a first capacity modulation passage;

a seal engaged with said first scroll member and said housing and defining a biasing chamber;

a second scroll member supported within said housing and including a second spiral wrap engaged with said first spiral wrap to form a series of pockets including a first pocket in communication with said first variable volume ratio passage and a second pocket in communication with said first capacity modulation passage;

a variable volume ratio valve assembly in communication with said first variable volume ratio passage and said discharge pressure region to selectively provide communication between said first pocket and said discharge pressure region;

a capacity modulation valve assembly in communication with said first capacity modulation passage and a suction pressure region of the compressor to selectively provide communication between said second pocket and said suction pressure region; and a biasing passage defined by said first end plate and in communication with said biasing chamber and a third pocket formed by said first and second scroll members, said biasing passage being located radially outward relative to said first variable volume ratio passage and radially inward relative to said first capacity modulation passage.

24. The compressor of claim 23, wherein said first end plate defines a second variable volume ratio passage in communication with the third pocket formed by said first and second scroll members and defines second capacity modulation passage in communication with a fourth pocket formed by said first and second scroll members, said variable volume ratio valve assembly including a first variable volume ratio valve controlling communication between said first pocket and said discharge pressure region and a second variable volume ratio valve controlling communication between said third pocket and said discharge pressure region independently from said first variable volume ratio valve, said capacity modulation valve assembly including a first capacity modulation valve controlling communication between said second pocket and said suction pressure region and a second capacity modulation valve controlling communication between said fourth pocket and said suction pressure region independently from said first capacity modulation valve.

25. The compressor of claim 23, further comprising a drive shaft engaged with said second scroll member to drive orbital displacement of said second scroll member relative to said first scroll member.

* * * * *

UNITED STATES PATENT AND TRADEMARK OFFICE

CERTIFICATE OF CORRECTION

PATENT NO. : 8,790,098 B2
APPLICATION NO. : 13/165306
DATED : July 29, 2014
INVENTOR(S) : Robert C. Stover et al.

It is certified that error appears in the above-identified patent and that said Letters Patent is hereby corrected as shown below:

On the Title Page

Page 3, Column 2, Item (56) Other Publications, Line 9, Delete "Inernational" and insert --International--.

In the Claims

Column 16, Line 7, Claim 24, after "defines", insert --a--.

Signed and Sealed this
Eighteenth Day of August, 2015

Michelle K. Lee

Michelle K. Lee
*Director of the United States Patent and Trademark Office*